US009014580B2

(12) United States Patent
Kasai et al.

(10) Patent No.: US 9,014,580 B2
(45) Date of Patent: Apr. 21, 2015

(54) IMAGE FORMING APPARATUS AND METHOD CAPABLE OF IMPROVING FIXING QUALITY

(75) Inventors: Tadashi Kasai, Tokyo (JP); Shinya Kobayashi, Tokyo (JP); Yoshihiro Sonohara, Tokyo (JP); Masakazu Terao, Tokyo (JP); Yoichi Sakurai, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 94 days.

(21) Appl. No.: 13/603,746

(22) Filed: Sep. 5, 2012

(65) Prior Publication Data

US 2013/0101303 A1 Apr. 25, 2013

(30) Foreign Application Priority Data

Oct. 20, 2011 (JP) ..... 2011-230354

(51) Int. Cl.
*G03G 15/00* (2006.01)
*G03G 15/20* (2006.01)

(52) U.S. Cl.
CPC ..... *G03G 15/205* (2013.01); *G03G 15/6585* (2013.01); *G03G 15/2064* (2013.01); *G03G 15/5029* (2013.01); *G03G 15/2078* (2013.01); *G03G 2215/00738* (2013.01); *G03G 2215/00751* (2013.01)

(58) Field of Classification Search
CPC ..... G03G 15/00
USPC ..... 399/45
See application file for complete search history.

(56) References Cited

U.S. PATENT DOCUMENTS

| | | | | |
|---|---|---|---|---|
| 6,212,352 | B1 * | 4/2001 | Kagawa et al. | 399/307 |
| 7,236,734 | B2 * | 6/2007 | Ng et al. | 399/341 |
| 7,421,231 | B2 * | 9/2008 | Bessho | 399/223 |
| 7,783,243 | B2 * | 8/2010 | Cahill et al. | 399/341 |
| 8,301,062 | B2 * | 10/2012 | Stelter | 399/223 |
| 8,351,825 | B2 * | 1/2013 | Kimura et al. | 399/222 |
| 8,447,204 | B2 * | 5/2013 | Qiao et al. | 399/82 |
| 8,503,919 | B2 * | 8/2013 | Sone et al. | 399/341 |
| 2004/0057748 | A1 * | 3/2004 | Egusa et al. | 399/107 |
| 2004/0095451 | A1 * | 5/2004 | Tatsumi et al. | 347/101 |
| 2008/0160435 | A1 * | 7/2008 | Lim et al. | 430/48 |
| 2010/0202789 | A1 * | 8/2010 | Kimura et al. | 399/39 |
| 2010/0226693 | A1 * | 9/2010 | Stelter | 399/299 |

(Continued)

FOREIGN PATENT DOCUMENTS

| | | |
|---|---|---|
| JP | 1-142740 | 6/1989 |
| JP | 9-311490 | 12/1997 |

(Continued)

OTHER PUBLICATIONS

U.S. Appl. No. 13/422,764, filed Mar. 16, 2012, Tokushima et al.

*Primary Examiner* — Clayton E Laballe
*Assistant Examiner* — Kevin Butler
(74) *Attorney, Agent, or Firm* — Oblon, McClelland, Maier & Neustadt, L.L.P.

(57) ABSTRACT

In an image forming apparatus, multiple toners are superimposed, formed and layered, on a recording medium and a toner image is made. The toner that superimposed lastly on the recording medium, that is, a top layer of toner, has a toner fixing characteristic value that causes the top layer of toner to be fixed on the recording medium by lower temperature than one or all of the other multiple toners. This provides for a better fixing quality.

20 Claims, 16 Drawing Sheets

(56) References Cited

U.S. PATENT DOCUMENTS

| | | | | |
|---|---|---|---|---|
| 2011/0008086 | A1* | 1/2011 | Matsudaira et al. | 399/341 |
| 2011/0182607 | A1* | 7/2011 | Takemura | 399/67 |
| 2012/0051816 | A1* | 3/2012 | Chiyoda | 399/341 |
| 2012/0107004 | A1 | 5/2012 | Sonohara et al. | |
| 2012/0177426 | A1* | 7/2012 | Fujita et al. | 399/341 |
| 2013/0101303 | A1* | 4/2013 | Kasai et al. | 399/45 |
| 2013/0164004 | A1* | 6/2013 | Ai | 399/40 |

FOREIGN PATENT DOCUMENTS

| | | | | |
|---|---|---|---|---|
| JP | 2004-77807 | | 3/2004 | |
| JP | 2004-191853 | * | 7/2004 | G03G 15/00 |
| JP | 2006-220987 | | 8/2006 | |
| JP | 2007183593 | * | 7/2007 | G03G 15/00 |
| JP | 2010113007 | * | 5/2010 | G03G 15/00 |

* cited by examiner

THE LOWER FIXING TEMPERATURE TONER IS ON THE TOP OF THE LAYER

| PAPER TYPE NO | BASIS WEIGHT ($g/m^2$) | PROCESS SPEED (mm/sec) | FIXING TEMPERATURE (°C) |
|---|---|---|---|
| 1 | 52.3 – 65.9 | 352.8 | 140 |
| 2 | 66 – 80.9 | 352.8 | 150 |
| 3 | 81 – 100.9 | 352.8 | 160 |
| 4 | 101 – 127.4 | 282 | 160 |
| 5 | 127.5 – 163.9 | 141 | 150 |
| 6 | 164 – 249.9 | 141 | 150 |
| 7 | 250 – 300 | 141 | 160 |

FIG. 10

THE LOWER FIXING TEMPERATURE TONER IS NOT ON THE TOP OF THE LAYER

| PAPER TYPE NO | BASIS WEIGHT ($g/m^2$) | PROCESS SPEED (mm/sec) | FIXING TEMPERATURE (°C) |
|---|---|---|---|
| 1 | 52.3 – 65.9 | 352.8 | 150 |
| 2 | 66 – 80.9 | 352.8 | 160 |
| 3 | 81 – 100.9 | 352.8 | 170 |
| 4 | 101 – 127.4 | 282 | 170 |
| 5 | 127.5 – 163.9 | 176.4 | 160 |
| 6 | 164 – 249.9 | 176.4 | 170 |
| 7 | 250 – 300 | 141 | 165 |

| PAPER TYPE NO | BASIS WEIGHT ($g/m^2$) | THE EXISTENCE OF THE IMAGE OF THE LOWER FIXING TEMPERATURE TONER | IMAGE PATTERN |
|---|---|---|---|
| 1 | 52.3 – 65.9 | NONE | – |
| 2 | 66 – 80.9 | NONE | – |
| 3 | 81 – 100.9 | NONE | – |
| 4 | 101 – 127.4 | NONE | – |
| 5 | 127.5 – 163.9 | NONE | – |
| 6 | 164 – 249.9 | EXIST | HALFTONE DOT |
| 7 | 250 – 300 | EXIST | SOLID |

| PAPER TYPE NO | BASIS WEIGHT ($g/m^2$) | THE EXISTENCE OF THE IMAGE OF THE LOWER FIXING TEMPERATURE TONER | HALF TONE DOT AREA RATIO (%) |
|---|---|---|---|
| 1 | 52.3 – 65.9 | EXIST ONLY WHEN HIGH GROSS PROCESSING | 0 – 100 |
| 2 | 66 – 80.9 | | 0 – 100 |
| 3 | 81 – 100.9 | | 0 – 100 |
| 4 | 101 – 127.4 | | 0 – 100 |
| 5 | 127.5 – 163.9 | | 0 – 100 |
| 6 | 164 – 249.9 | EXIST | 50 – 100 |
| 7 | 250 – 300 | | 100 |

FIG. 24
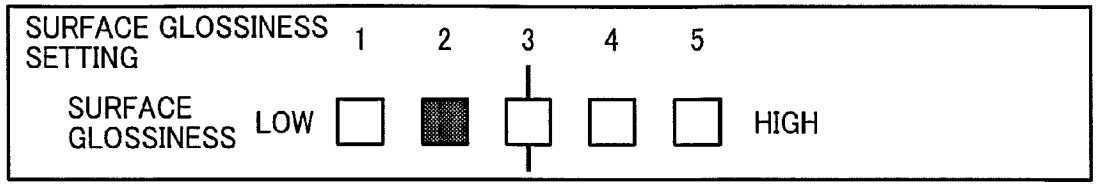
FIG. 25
PRIORITY IN LOWERING FIXING TEMPERATURE
↕
PRIORITY IN DECREASING TONER CONSUMPTION
| PRIORITY NO. | HALF TONE DOT AREA RATIO (%) | LINES PER INCH (lpi) | DOT GEOMETRY | ANGLE (DEGREE) | FIXING TEMPERATURE (°C) |
|---|---|---|---|---|---|
| 1 | 95 | 30 | LINE | 45 | 160 |
| 2 | 84 | 80 | LINE | 45 | 161 |
| 3 | 70 | 130 | LINE | 45 | 162 |
| 4 | 70 | 180 | LINE | 45 | 163 |
| 5 | 60 | 220 | LINE | 45 | 165 |
FIG. 26
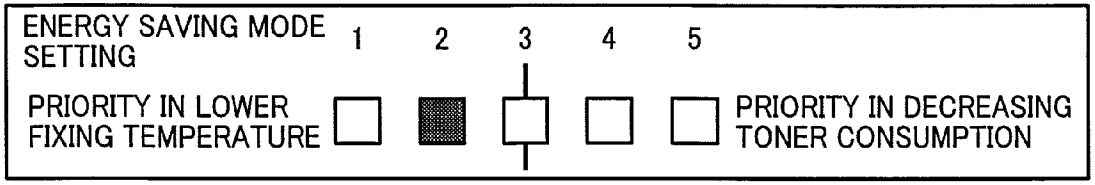

FIG. 28

| PAPER TYPE NO | BASIS WEIGHT ($g/m^2$) | THE EXISTENCE OF THE IMAGE OF THE LOWER FIXING TEMPERATURE TONER | EXPOSURE LIGHT POWER (%) |
|---|---|---|---|
| 1 | 52.3 – 65.9 | NONE | – |
| 2 | 66 – 80.9 | NONE | – |
| 3 | 81 – 100.9 | NONE | – |
| 4 | 101 – 127.4 | NONE | – |
| 5 | 127.5 – 163.9 | NONE | – |
| 6 | 164 – 249.9 | EXIST | 50 |
| 7 | 250 – 300 | EXIST | 100 |

IMAGE FORMING APPARATUS AND METHOD CAPABLE OF IMPROVING FIXING QUALITY

CROSS-REFERENCE TO RELATED APPLICATIONS

This patent application is based on and claims priority pursuant to 35 U.S.C. §119 to Japanese Patent Application Nos. 2011-230354, filed on Oct. 20, 2011, in the Japanese Patent Office, the entire content of which is hereby incorporated by reference herein.

BACKGROUND

1. Technological Field

The exemplary embodiments described herein relate to an image forming apparatus and an image forming method.

2. Description of the Related Art

Conventionally, image forming apparatuses in electrophotography that use process color toners such as cyan, magenta, yellow and black set a limit of total toner quantity per unit image area (or pixel) to prevent problems like fixing offset, poor fixing quality or a paper jam caused by adhesion of a paper to a fixing member. Such technology is described in Japanese Patent Publication No. 2004-77807 and No. 2004-191853.

This technology decreases problems like fixing offset, poor fixing quality or a paper jam caused by adhesion of a paper to a fixing member.

SUMMARY

The exemplary embodiments described herein can provide at least an image forming apparatus comprising multiple image making units that are able to layer toner images on a recording medium, where a fixing characteristic value of a toner of the top layer is a value that makes it possible to fix the toner of the top layer on the recording medium at a lower temperature than the toners of the other layers. In other words, the toner of the top of the layer has a lower fixing temperature than the other toners.

The exemplary embodiments described herein can also provide at least an image making method, comprising superimposing different toners on a recording medium to make an image on the recording medium, wherein the toner superimposed lastly has a fixing temperature that is lower than the other toners.

However, other aspects and/or exemplary embodiments are presented in this disclosure, and discussed in detail below.

BRIEF DESCRIPTION OF THE DRAWINGS

A more complete appreciation of the exemplary embodiments described herein and many of the attendant advantages thereof will be more readily obtained as the same becomes better understood by reference to the following detailed description when considered in connection with the accompanying drawings, wherein:

FIG. 10 is a table showing examples of characteristics of each paper type when the lower fixing temperature toner is not on the top of the toner layers;

FIG. 24 is an illustration of an exemplary operation display panel for setting a surface glossiness;

FIG. 25 is a table showing an example of energy saving mode information in a fifth embodiment;

FIG. 26 is an illustration of an exemplary operation display panel for an energy saving mode;

FIG. 28 is a table showing examples of characteristics of each paper type in the sixth embodiment.

DETAILED DESCRIPTION

Some embodiments are explained as follows.

The First Embodiment

Figure 1:
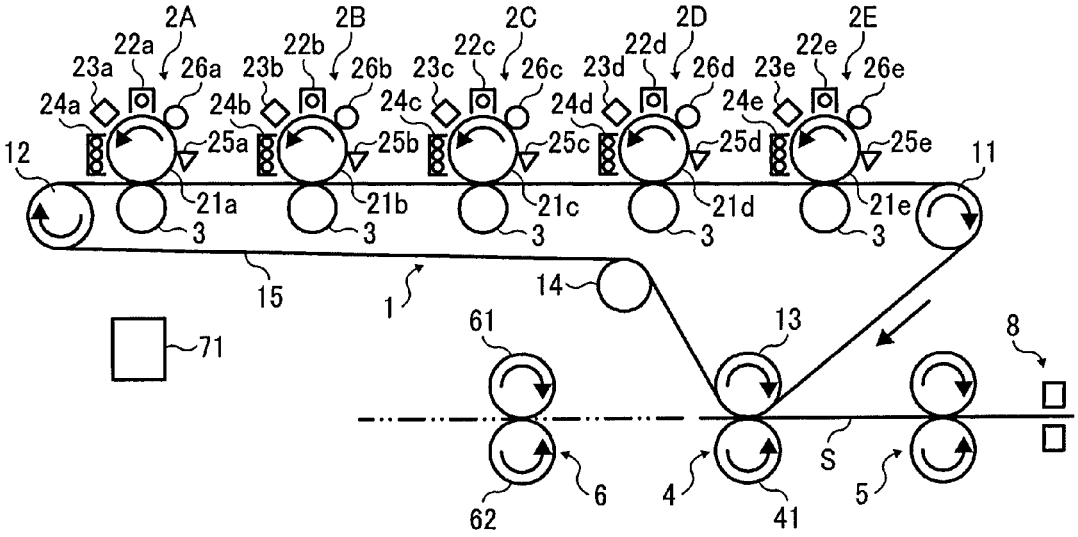
FIG. 1 is a schematic diagram showing an exemplary configuration of an image forming apparatus.

An image forming apparatus in the first embodiment has an image making system shown in FIG. 1 including a developer. The image making system has an intermediate transfer belt unit 1, image forming unit 2A-2E, a first transfer unit 3, a second transfer unit 4, a sheet feeding unit 5, a fixing unit 6 and a controller 71. An image forming apparatus can also have a feeding paper tray, an output paper tray, an ADF (Auto Document Feeder), a scanner unit, a document output paper tray, a display panel and other units.

The intermediate transfer belt unit 1 has a driving roller 11, a driven roller 12 located a predetermined distance from the driving roller 11 in a lateral direction, a second transfer opposing roller 13 located below both rollers and near the driving roller 11, a tension roller 14 located between the driven roller 12 and the second transfer opposing roller 13, and a intermediate transfer belt 15 set in these rollers. Driving roller 11 rotates the intermediate transfer belt 15 clockwise, with respect to the orientation shown in FIG. 1, in the intermediate transfer belt unit 1.

The five image forming units 2A-2E are located side by side at a predetermined distance along the intermediate transfer belt between the driving roller 11 and the driven roller 12.

These five image forming units 2A-2E shown in FIG. 1 comprise, from left to right in FIG. 1, an image forming unit 2A for making the image (for giving surface glossiness or watermark) of clear and colorless toner that is lower fixing temperature toner, an image forming unit 2B for making a yellow toner image, an image forming unit 2C for making a cyan toner image, an image forming unit 2D for making a magenta toner image and an image forming unit 2E for making a black toner image. The mechanical structures between the image forming units are substantially the same. However, the image forming units each contain a different developer. The clear and colorless toner, which has a lower fixing temperature than the other toners, is referred to hereinafter as "clear toner."

Each image forming unit 2A-2E has a respective photoconductor drum 21 (21*a*-21*e*), a charger 22 (22*a*-22*e*), an exposure unit 23 (23*a*-23*e*), a developing unit 25 (25*a*-25*e*), a discharging unit 25 (25*a*-25*e*) and a cleaning unit 26 (26*a*-26*e*).

The photoconductor drum 21 (21*a*-21*e*) shown in FIG. 1 is rotatable in a counter clockwise, with respect to the orientation shown in FIG. 1, and contacts the intermediate transfer belt 15. An electrostatic latent image and its toner image are formed thereon. The charger 22 (22*a*-22*e*) charges the surface of the photoconductor drum 21 (21*a*-21*e*) uniformly. The exposure unit 23 (23*a*-23*e*) exposes light based on digital electrostatic latent image signals onto the surface of the photoconductor drum 21 (21*a*-21*e*) charged by the charger 22 (22*a*-22*e*) to form an electrostatic latent image.

The developing unit 24 (24*a*-24*e*) develops the electrostatic latent image by using toner in a two component developer, which is described later, to make a toner image. The discharging unit 24 (24*a*-24*e*) discharges the surface of the photoconductor drum 21 (21*a*-21*e*) after the toner image is transferred to the intermediate transfer belt 15. The cleaning unit 26 (26*a*-26*e*) removes residual toner after the transfer, and, e.g., paper, dust, etc., left on the surface of the photoconductor drum 21 (21*a*-21*e*) discharged by the discharging unit 25 (25*a*-25*e*).

The first transfer unit 3 faces the photoconductor across the intermediate transfer belt. By applying a transfer bias, the toner image on each surface of the photoconductor drum 21 (21*a*-21*e*) is transferred to the intermediate transfer belt 15.

The second transfer unit 4 has a second transfer roller 41 which faces the second transfer opposing roller 13 across the intermediate transfer belt 15. By applying a second transfer bias to the second transfer roller 41, the toner image on the intermediate transfer belt 15 is transferred to the paper S (an example of a sheet recording medium) carried between the intermediate transfer belt 15 and the second transfer roller 41. The structure that applies a transfer bias to the second opposing roller 13 may be used instead of one that applies transfer bias to the second transfer roller 41 to transfer the toner image on the intermediate transfer belt 15 to the paper S.

A sheet feeding unit 5 includes a pair of rollers located upstream of the second transfer unit 4 in the direction of carrying the paper S. It pinches the tip of the paper S, holds it, and sends the paper S to the second transfer unit 4 at a desirable timing.

Figure 2:
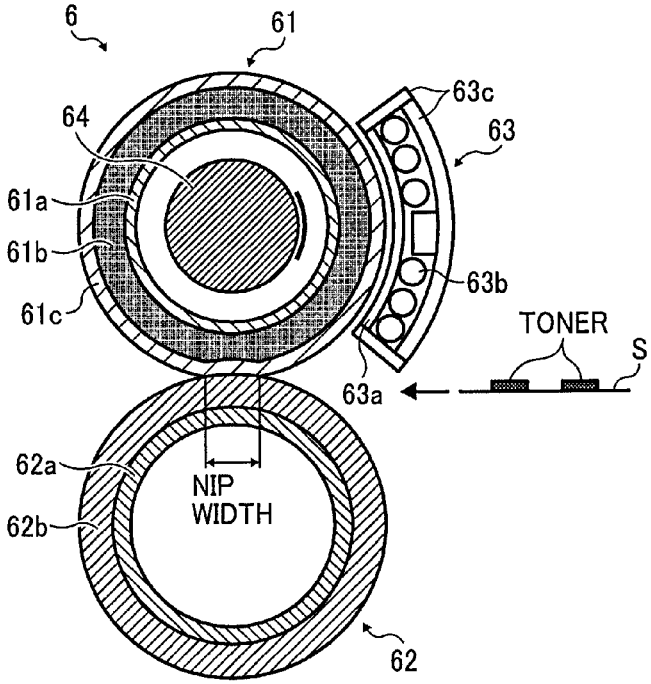
FIG. 2 is a schematic vertical cross-sectional view showing an exemplary configuration of a fixing unit.

A fixing unit 6 shown in FIG. 2 has a fixing roller 61, a pressure roller 62, an induction heating unit 63, an internal core 64, and a thermistor. The fixing unit 6 is located downstream of the second transfer unit 4 shown in FIG. 1 in the direction of carrying the paper S.

The fixing roller 61 comprises an elastic layer 61*b* and a heating layer 61*c* on a cylindrical core metal 61*a* and is rotatable by a driving source. The pressure roller 62 comprises elastic layer 62*b* made by fluorine-containing rubber, silicon rubber or the like on a cylindrical member 62*a* made by aluminum, copper or the like and is pressed against the fixing roller 61 to be rotatable with it.

An induction heating unit 63 comprises a coil guide 63*a* formed arc-like along the outer surface of the fixing roller 61, a coil unit 63*b* formed by winding thin wire around the coil guide 63*a* and the core unit 63*c* that covers the coil unit 63*b* by a ferromagnetic body (that has a relative magnetic permeability equal to about 1000-3000), like ferrite, and generates a magnetic flux toward the heating layer 61*c*. In the induction heating unit 63, a high frequency alternate current in the coil unit 63*b* forms an alternating magnetic field between the core unit 63*c* and the internal core 64. The alternating magnetic field generates an eddy current in the heating layer 61*c* that results in the eddy current heating by the resistance of heating layer 61*c*. As a result, the fixing roller 61 is heated.

A thermistor is set to detect the temperature on the fixing roller 61 (fixing temperature). Based on the detected temperature, the controller 71 (described hereinafter) controls heating by the induction heating unit 63.

Herein, the contacting part of fixing roller 61 and the pressure roller 62 is called a nip. The length that both rollers are in contact, as shown in FIG. 2, is called a nip width. The time calculated from the nip width divided by the rotational speed of the fixing roller 61 (that is, a transit time which a point on the paper S goes through the nip width) is called a nip time. A pressure power of the pressure roller 62 that presses the fixing roller 61 (that presses the paper S) is herein called pressure power.

The fixing unit 6, like above, applies heat and pressure to the paper S having adhered unfixed toner image, and melts the toner and fixes it on the paper.

Figure 3:
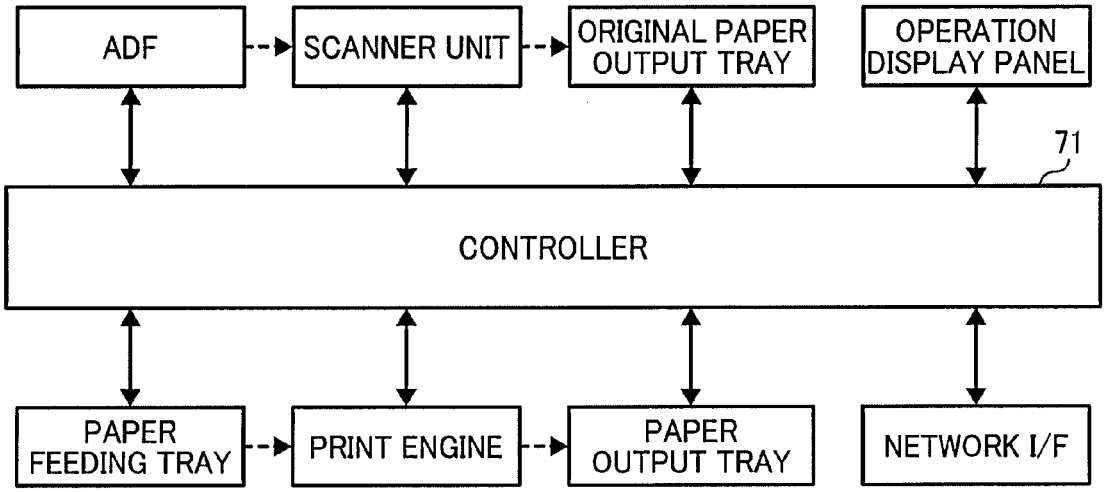
FIG. 3 is an explanatory block diagram showing the relationship among a controller and other units in a first embodiment.

A controller 71, as shown in FIG. 3, is configured to control the function of a image forming apparatus, such as control of mechanical parts like an ADF (Auto Document Feeder), a scanner unit, a document output tray, a feeding paper tray, a print engine, an output paper tray, an exposure unit, fixing temperature control in fixing unit 6, image data processing that generates digital electrostatic latent image forming signals to make toner images of yellow, magenta, cyan and black toner (e.g., signals for making half tone dot images) from an image data (a raster image that is the image expressed by a group of pixels) based on total toner quantity control, input-output control of information in an operation display panel, and input-output control with outer peripherals (e.g., a personal computers) using network interface. Specifically, a CPU (Central Processing Unit) executes a control program and control units to perform operations of the image forming apparatus.

In the image data processing that generates digital electrostatic latent image forming signals, digital electrostatic latent image forming signals for clear toner image positioned at the top of toner layers on the paper S are also generated. The image forming pattern by clear toner covers the paper. In this image data processing, raster image processing is executed when input data is in the page-description language (PDL).

The print engine has a structure for image forming, such as the intermediate transfer belt unit 1, the image forming units 2A-2E, the first transfer unit 3, the second transfer unit 4, the sheet feeding unit 5, the fixing unit 6 and the like. In FIG. 3, the flow of electrical signals is shown by solid lines with arrows and the flow of papers is shown by dotted lines with arrows.

Next, the image forming actions in the above image making system will be explained. The controller 71 receives image data from the scanner unit, a personal computer or the like, and generates digital electrostatic latent image forming signals for making toner images of yellow, cyan, magenta, black and clear toner. The digital electrostatic latent image forming signals for making toner images of yellow, cyan, magenta and black toner are generated based on the total toner quantity control technology. The exposure unit 23 (23*a*-23*e*) exposes light based on the digital electrostatic latent image forming signals to the rotating photoconductor drum 21 (21*a*-21*e*), the surface of which is charged uniformly by the charger 22 (22*a*-22*e*) to form an electrostatic latent image.

The developing unit 24 (24*a*-24*e*) develops the electrostatic latent image formed on the photoconductor drum 21 (21*a*-21*e*) to make the toner image. The electrostatic latent image making action and developing action are synchronized with the rotation of the intermediate transfer belt 15. Each toner image making action proceeds with clear toner, yellow toner, cyan toner, magenta toner and black toner in this order.

Figure 4:
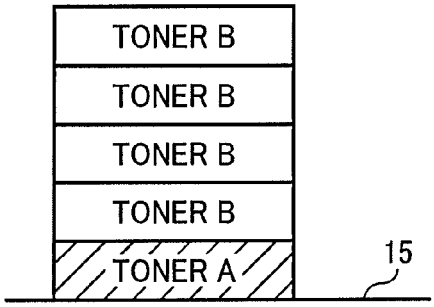
FIG. 4 is a drawing showing a stacking sequence of toner images on a intermediate transfer belt.

The first transfer unit 3 forms a transfer electric field, transfers the toner image on each photoconductor drum 21 (21*a*-21*e*) to the rotating intermediate transfer belt 15 sequentially, and superimposes them (the first transfer). Clear, yellow, cyan, magenta and black toner image are superimposed on the intermediate transfer belt 15 in this order and sometimes forms toner layers shown in FIG. 4. In FIG. 4, toner A identifies clear toner and toners B identify process color toners like yellow, cyan, magenta and black toner. The intermediate transfer belt 15 rotates and carries the transferred toner image on its surface to the second transfer opposing roller 13.

The total quantity of toner per unit area (or pixel) including yellow, cyan, magenta, and black toner image is limited by total toner quantity control. However, adding clear toner image for surface glossiness or a watermark may make the part (or pixel) that is over a limit quantity of the total toner quantity control. This can result in problems such as a fixing offset, poor fixing quality, and a jam caused by adhesion of a paper and a fixing member in conventional technology. However, in accordance with aspects of this disclosure, such problems are prevented by using a clear toner as discussed herein.

Figure 5:
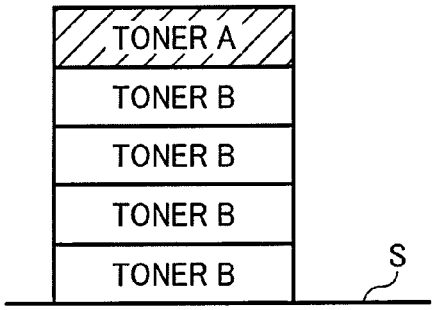
FIG. 5 is a drawing showing a stacking sequence of toner images on a paper.

In parallel with the above action, the paper S is carried to the sheet feeding unit 5 by a paper carrying unit that comprises rollers and guides. The sheet feeding unit 5 pinches the tip of the paper S, holds it and sends the paper S to the part of the second transfer opposing roller between the second transfer roller 41 and the intermediate transfer belt 15 at a desirable timing. The second transfer roller 41 forms a transfer electric field and transfers the toner images of all toners on the intermediate transfer belt 15 to the paper S in a lump (second transfer). After the second transfer, clear toner image is positioned at the top of the toner layers, as shown in FIG. 5.

The paper S, with the transferred toner images, is carried to the fixing unit 6 by the paper carrying unit. The toner fixing unit 6 fixes the toner images on the paper S by adding heat and pressure to the paper S with the toner images, and the paper S, with the fixed toner images, is outputted to the output paper tray. Then an image forming action is finished.

Next, a developer used in each developing unit will be explained. A developer used in each developing unit is a two component developer that has toner and carrier. The thermal property of the clear toner positioned at the top of the toner layers on the paper S has a lower fixing temperature property than the thermal property of the other toners like yellow, cyan, magenta and black toner, that are not positioned at the top of the toner layers.

Generally, toner comprises a colorant like dye or pigment, a crystalline polyester resin, a binder resin, a lubricating agent and an incompatible wax with the binder resin. The lubricant agent affects the compatibility of the binder resin and the crystalline polyester resin. By adjusting the kind and quantity of the lubricant agent, the compatibility is changed, and the thermal property of the toners is controlled.

In the clear toner positioned at the top of the toner layers on the paper, the colorant is removed from the above components. Further, the kind or quantity of its lubricating agent is changed from the kind or quantity of the other toners like yellow, cyan, magenta and black toner that are not positioned at the top of the toner layers to control its compatibility. When color toners comprise a white binder resin or a white crystalline polyester resin, more clear resin may be used instead of these resins.

Examples of the lubricant agent are montanic acid ethylene glycol ester wax, montanic acid glycerin ester wax, montanic acid butylene glycol ester wax, montanic ester saponificated calcium hydroxide part wax, montanic acid aliphatic polyol ester wax, montanic acid natrium wax, montanic acid lithium wax and the like.

Examples of the wax are polyolefin wax (polyethylene wax, polypropylene wax, and the like), long-chain hydrocarbon (paraffin wax, Sasol Wax, and the like), a carbonyl group-containing wax, and the like. Of these examples, the carbonyl group-containing wax is preferable. Examples of the carbonyl group-containing wax are polyalkanoic ester (carnauba wax, trimethylolpropane tribehenate, pentaerythritol tetrabehenate, pentaerythritol diacetate dibehenate, glycerin tribehenate, octadecan-1,18-diol distearate, and the like), polyalkanol ester (trimellitic tristearate, distearyl maleate, and the like), polyalkanoic acid amide(dibehenyl amide and the like), polyalkyl amide(trimellitic acid tristearyl amide, and the like), dialkyl ketone (distearyl ketone, and the like), and the like. Of these carbonyl group-containing wax, the polyalkanoic ester is particularly preferable.

The toner may be made by a known kneading and crushing method from these materials. However, it is preferable to get toner by the following method. That is, toner materials containing urea-modified polyester resins are solved in organic solvent, polymerized in water, removed the solvent of the dispersion liquid, and cleaned.

As stated above, in the image forming apparatus of the first embodiment, the thermal property of the toner positioned at the top of the toner layers (that is clear toner in this case) has a lower fixing temperature property than that of the other toners that are not positioned at the top of the toner layers (that is the process color toners in this case). Although adding clear toner image for surface glossiness or watermark may make the part (or pixel) over a limit quantity of the total toner quantity control, the above embodiment prevents a poor fixing quality. The experimental results exemplifying this and other effects will be explained bellow.

<The Thermal Property of Toner>

By adjusting a lubricating agent, two toners that have a different half-flow start temperature (T½) and fixing temperature of the lower limit were prepared (hereinafter called toner A and toner B). Toner A was clear toner. Toner B was a process color toner, such as yellow, cyan, magenta or black toner.

The half-flow start temperature of toner A was about 110° C. The half-flow start temperature of toner B was about 125° C. The half-flow start temperature was measured as follows. Using flow tester (CFT-500 or CFT-100 made by Shimadzu Corporation), in the condition of dies diameter 1 mm, pressure 20 kg/cm$^2$ and temperature rising speed 6° C./min, the sample toner 1 cm$^3$ was solved and drained. The half-flow start temperature is the temperature measured when the sample height becomes a half of the height between drain start point and drain end point.

The fixing temperature of the lower limit of toner A was lower than that of toner B. This was obtained by the following method. The effect of the embodiment was confirmed in comparison with the fixing quality of three samples, only toner A fixed on the paper, only toner B fixed on the paper, and toner A on the toner B fixed on the paper.

<The Fixing Condition>

The fixing condition of the fixing unit 6 is shown as follows. It is convenient for measurement to convert the fixing unit in the commercial copier and make it drive without copying.

Nip width: 14.0 mm±0.3 mm
Nip time: 40 msec
Pressure: 468 N in only one side
Fixing temperature: 125-135° C. (in less toner adhered); 125-140° C. (in much toner adhered)
The fixing temperature was changed step by step.

<Sampling>

There were six kinds of samples, only toner A fixed on the paper, only toner B fixed on the paper, toner A on the toner B fixed on the paper, and toner adhered much or less in each three cases. In each sample, the fixing temperature was changed step by step, and samples of fixed toner on the paper in each fixing temperature were obtained. In sampling, 70 w paper (A4 size, ream weight 70 kg, for PPC) was used. Ream weight means the weight of 1000 papers (A4 size).

Figure 6:
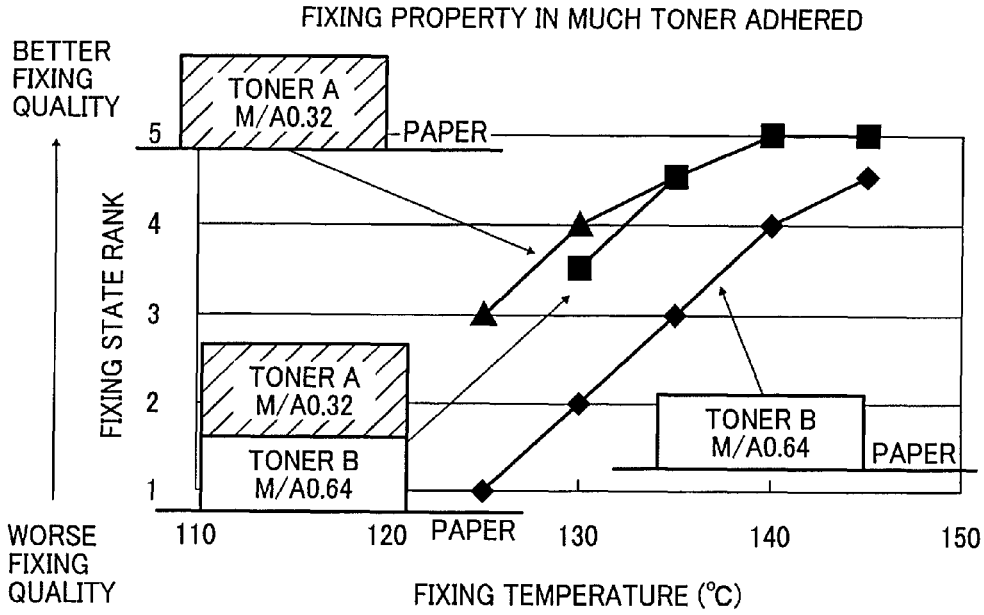
FIG. 6 is a graph showing an exemplary relationship between fixing temperature and fixing quality in much toner adhered.

Toner adhered quantity M/A (mg/cm$^2$) of toner A and toner B in much toner adhered were as follows.
Only toner A on the paper: 032 mg/cm$^2$
Only toner B on the paper: 0.64 mg/cm$^2$
Toner A on the toner B with paper: toner A 0.32 mg/cm$^2$ and toner B 0.64 mg/cm$^2$
This data is shown in FIG. 6.

Figure 7:
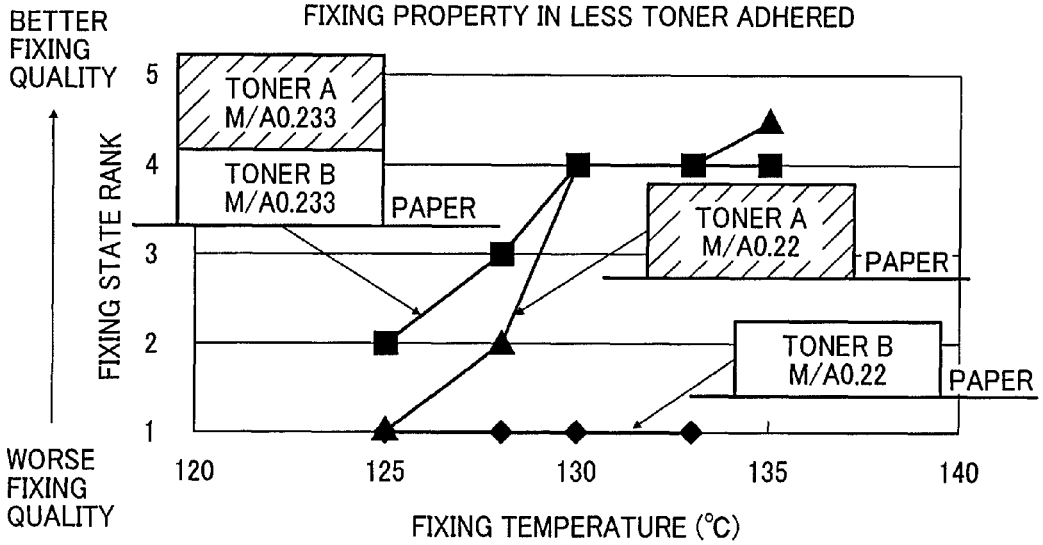
FIG. 7 is a graph showing an exemplary relationship between fixing temperature and fixing quality in less toner adhered.

Toner adhered quantity M/A (mg/cm$^2$) of toner A and toner B in less toner adhered were as follows.
Only toner A on the paper: 0.22 mg/cm$^2$
Only toner B on the paper: 0.22 mg/cm$^2$
Toner A on the toner B with paper: toner A 0.233 mg/cm$^2$ and toner B 0.233 mg/cm$^2$
This data is shown in FIG. 7.

<The Evaluation for Sample>

The fixing state of the samples was evaluated as follows. Firstly, five specimens were made that represent five different fixing states. Each specimen was scratched by a needle with the predetermined pressure. As a result, each specimen showed a different trail corresponding to the different fixing state, and each specimen was ranked based on the fixing state. The specimen of the strongest fixing state was called rank 5, whereas the one of the weakest fixing state was called rank 1, with the other three specimens called rank 2 to rank 4 corresponding to its fixing state. A larger rank number indicates a stronger fixing state according to the following explanation.

Samples that were obtained in the above experiment were scratched by a needle in the above same way, and ranked relative to the above five specimens. The results are shown in FIG. 6 and FIG. 7.

The results in much toner adhered are shown in FIG. 6. For example, the sample fixed only toner A had a rank 4 at the fixing temperature of 130° C. The sample fixed only toner B had a rank 4 at the fixing temperature of 140° C. The sample fixed only toner A had a rank between rank 4 and rank 5 at the fixing temperature of 135° C. The sample fixed only toner B had a rank between rank 4 and rank 5 at the fixing temperature of 145° C.

Because toner A has a lower half-flow start temperature than toner B, the rank of the sample fixed only toner A was the same at the lower fixing temperature than that of the sample fixed only toner B. The difference was 10° C. The results of FIG. 6 show toner A has a lower fixing temperature of the lower limit than toner B.

The rank of the sample fixed the toner A on the toner B with the paper had a rank between rank 4 and rank 5 at the same temperature of 135° C. with the sample fixed only toner A instead of the existence of toner B.

Next, the results of fixing state in less toner adhered are shown in FIG. 7. Comparing with FIG. 6, the rank of all results went down, but the tendency was similar with FIG. 6. Thus, making the toner thermal property of the top of the toner image layer possible to fix the toner on the paper S by a lower temperature than the other toners, that is, making the toner of the top of the layer the lower fixing temperature toner, the fixing state can be made a same level of the sample fixed only the lower temperature toner in spite of the existence of other toners and thick toner layers. This provides a new way to improve fixing quality.

As stated above, in this first embodiment, the fixing state is improved even when adding clear toner image for surface glossiness or watermark to make a part (or pixel) that is over a limit quantity of the total toner quantity control.

The Second Embodiment

As explained in the first embodiment, by making the toner thermal property enable a lower fixing temperature than the other toners, a better fixing state can be achieved.

However, types of papers (the difference of basis weight, the difference of ream weight, the difference of paper kinds like PPC paper, matte paper, art paper, coat paper, etc., hereinafter called paper type) affects fixing state. For example, thick paper is difficult to achieve good fixing quality with, compared to thin papers, because thick paper absorbs heat from the fixing roller and decreases the fixing temperature.

So, the image forming apparatus in the second embodiment makes it possible to change the fixing condition to accommodate each paper type. The explanation of the same structure with the first embodiment is omitted in the following explanation. In the explanation, basis weight means the paper weight per 1 $m^2$. And ream weight means the weight of 1000 papers of a predetermined size.

The image forming apparatus in the second embodiment shown in FIG. 2 has a paper detecting unit 8 and a controller 72.

The paper detecting unit 8 comprises a light emitting part, a light receiving part that receives the light from light emitting part, a transmission type photointerrupter to detect the paper passing between the light emitting part and the light receiving part in a paper carrying pass between the paper feeding tray and the print engine shown in FIG. 1, and an interface that receives an output voltage from the transmission type photointerrupter, converts the analog voltage into a digital signal, and sends the signal as the detected information to controller 72.

Instead of the transmission type photointerrupter, a reflective photointerrupter may be used that has a receiving part to receive the light reflected by the paper from the light emitting part in that the paper passes between the feeding paper tray and print engine. Both the transmission type photointerrupter and the reflective photointerrupter may be used in the paper detecting unit 8. Instead of the photointerrupters, paper type detection sensors may be used, which comprise a heater that heats a paper carried, and a temperature sensor that detects the heated paper temperature (to determine a heat capacity of the paper) and outputs a voltage corresponding to the paper temperature.

Figures 8, 9:
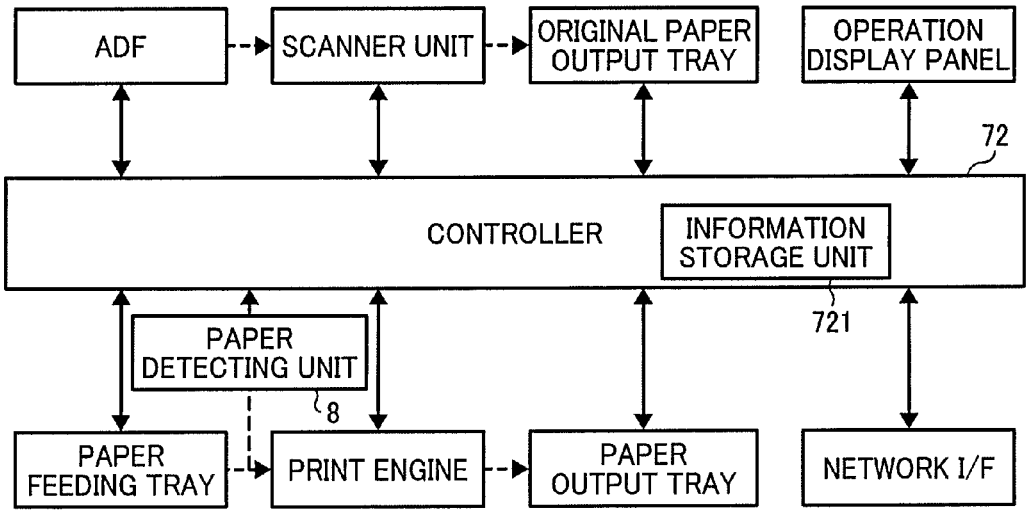
FIG. 8 is an explanatory block diagram showing the relationship among a controller and other units in a second embodiment.
FIG. 9 is a table showing examples of characteristics of each paper type when the lower fixing temperature toner is on the top of the toner layers.

The controller 72 shown in FIG. 8 has an information storage unit 721 and the structures shown in the first embodiment. The information storage unit 721 stores threshold values to identify the paper type based on the detected information from the paper detecting unit 8, a speed control data to control the speed of the fixing roller 61 and the pressure roller 62 in the fixing unit 6 for adjusting nip time, and fixing temperature control data to control electric power for the induction heating unit 63 in the fixing unit 6 for adjusting the fixing temperature.

An example that relates paper types corresponding to basis weight to each control data is shown in FIG. 9 and FIG. 10. FIG. 9 shows the case that the lower fixing temperature toner (clear toner) is on the top of the layer. FIG. 10 shows the case that the lower fixing temperature toner (clear toner) is not on the top of the layer.

As shown in FIG. 9 and FIG. 10, paper type number is related to the basis weight to identify the paper type, the speed of the fixing roller 61 and the pressure roller 62 in the fixing unit 6 and the fixing temperature of the fixing unit 6. Controllable information based on these tables is stored in the information storage unit 721. In this embodiment, control data of controllable information based on FIG. 9 is called the fixing condition 1 and control data of controllable information based on FIG. 10 is called the fixing condition 2. The fixing temperature in FIG. 9 is lower than that in FIG. 10 because the fixing temperature can be set lower when the lower fixing toner is on the top of the toner image layer as shown in FIG. 6 and FIG. 7. The values in FIG. 9 and FIG. 10 are just examples and not limited in this embodiment.

The controller 72 makes it possible for a user to switch paper type detection from being active to not being active by a setting operation display panel. Switching is done by setting a paper type to a feeding paper tray. If a user set the feeding paper tray 1 to normal papers for PPC and the feeding paper tray 2 to postcards for PPC, then paper type isn't detected. If user doesn't set the feeding paper tray to paper type, then paper type is detected. And the controller 72 makes it possible that a user chooses whether the lower fixing toner image (clear toner) superimposes the process color image or not by the setting operation display panel.

Figure 11:
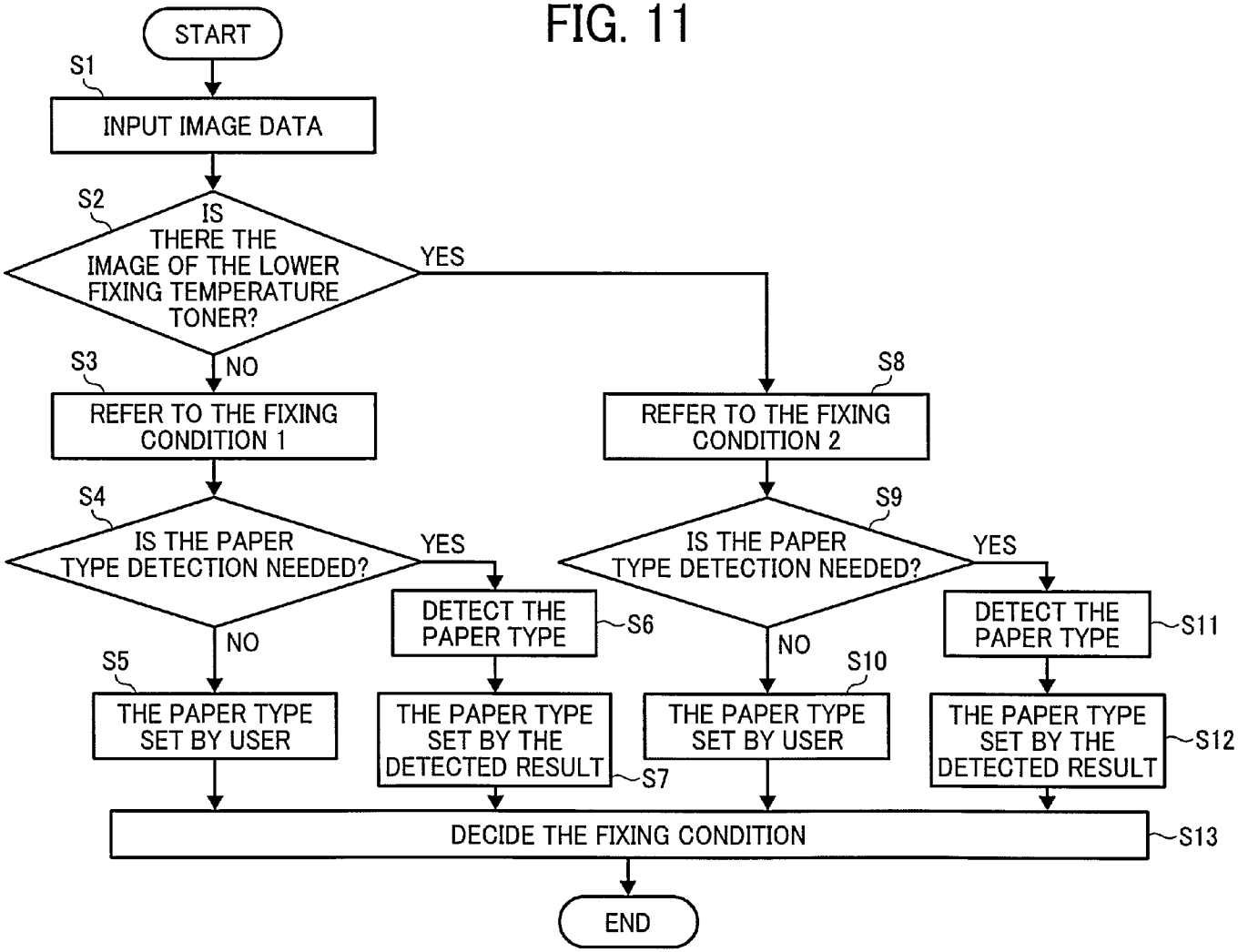
FIG. 11 is a flowchart showing an exemplary algorithm for deciding a fixing condition.

Next, an exemplary sequence from image data input to decision of the fixing condition shown in FIG. 11 will be explained.

Firstly, image data is inputted from scanner unit, personal computer or processing device to the controller 72 (S1). The controller the judges (determines whether) the image data includes a clear toner image at the top of the toner image layer or not (S2). If the image data doesn't include a clear toner image (S2 No), then the controller refers the fixing condition 1 (S3). If the image data includes a clear toner image (S2 Yes), then the controller refers the fixing condition 2 (S8).

Next, the need of paper detection is judged (S4, S9). If the paper detection is not needed, that is, the user sets the feeding paper tray to the paper type (S4, S9 No), then the controller 72 sets a paper type number according to the user setting (S5, S10). If the paper detection is needed, that is, the user doesn't set the feeding paper tray to the paper type (S4, S9 Yes), then the controller 72 executes the paper detection (S6, S11). The controller 72 compares the detected information from the paper detecting unit with the threshold values stored in the information storage unit 721 and decides a paper type number (S7, S12).

Based on the paper type number, the fixing condition is decided (S13). After that, an image making action is executed in the decided fixing condition. For example, when the clear toner is at the top of the toner image layers, and the result of paper detection is paper type number 6, the speed of the fixing roller 61 and the pressure roller 62 in the fixing unit 6 is set to 141 mm/sec and the fixing temperature in the fixing unit 6 is set to 160° C., and they are controlled constantly.

In this second embodiment, because the fixing condition is changed based on each paper type, a good constant fixing state is achieved with different paper types.

The Third Embodiment

The image forming apparatus in the second embodiment changes the fixing condition in each paper. The image forming apparatus in the third embodiment changes the lower fixing temperature toner quantity at the top of the layers including no lower fixing temperature toner in each paper type by using the area coverage modulation method. The area coverage modulation method is the method for making gray scale by changing the area ratio of the area adhered toner and no toner area. In the third embodiment, a half tone dot image is used. The explanation of the same structure with the first and the second embodiment is omitted. Further, clear toner is used as the lower fixing temperature toner in this embodiment.

The image forming apparatus in the third embodiment has a controller 73 and the paper type detecting unit 8 discussed in the second embodiment. The controller 73 shown in FIG. 12 has an information storage unit 731, an image data processing unit 732, and the structure shown in the first embodiment.

The information storage unit 731 stores threshold values to identify the paper type based on the detected information from the paper detecting unit 8, existence information of clear toner image that is related to whether clear toner should exist with each paper type (that shows which paper type needs clear toner covering), and image forming pattern information that relates to an image forming pattern of clear toner image to paper type to control a quantity of clear toner at the top of the image.

Figures 12, 13:
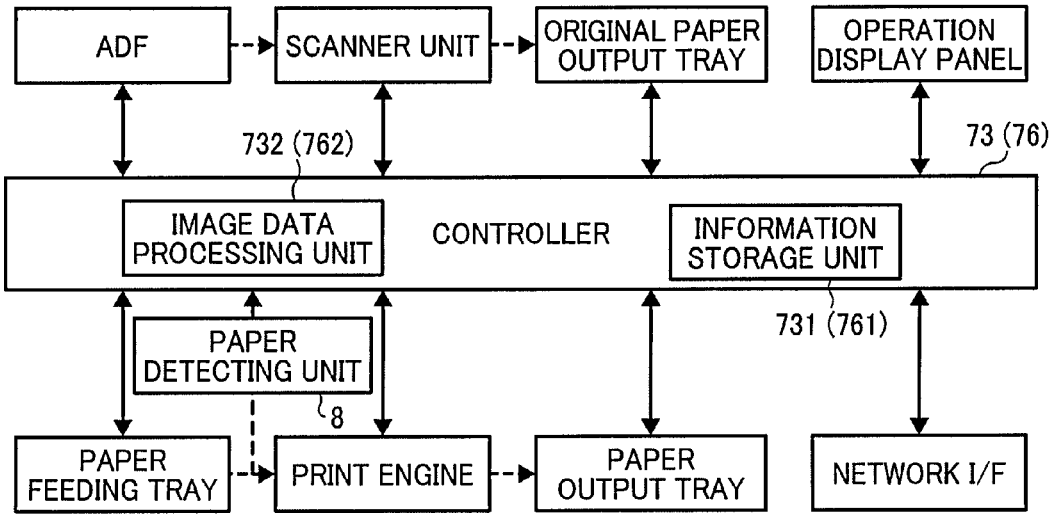
FIG. 12 is an explanatory block diagram showing the relationship among a controller and other units in a third embodiment.
FIG. 13 is a table showing examples of characteristics of each paper type in the third embodiment.

FIG. 13 shows an example that relates paper types (based on different basis weight) to each information stated above. However, this is just merely one example, and other implementations can be utilized.

As shown in FIG. 13, the paper type number is related to the basis weight to identify paper, the existence of the clear toner image (that is the existence of the image of the lower fixing temperature toner) and its image pattern. Controllable information based on this table is stored in the information storage unit 731.

The image data processing unit 732 makes digital electrostatic latent image signals (e.g., signals for generating half tone dot images) for forming images of toner like yellow, magenta, cyan, and black toner from image data (raster image data) based on the total quantity toner control and judges whether digital electrostatic latent image signals for clear toner images should be made or not based on a paper type. And it chooses, decides and generates the image forming pattern of the clear toner image. In this third embodiment, an image forming pattern is a solid pattern that covers the paper wholly by toner or half tone dot image pattern that covers paper by a dot pattern.

Figure 14:
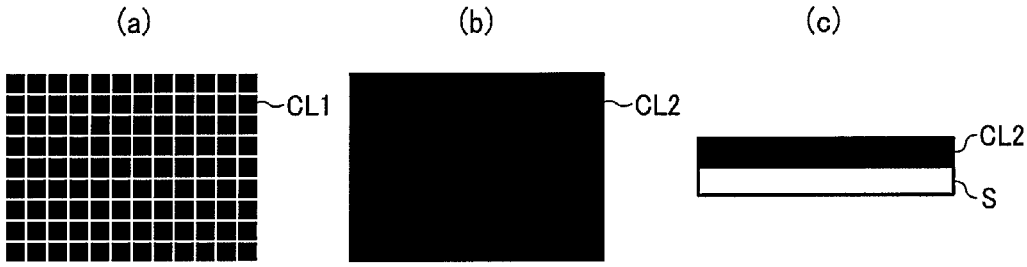
FIGS. 14(*a*)-(*c*) are drawings showing a relationship between a quantity of a clear and colorless toner and a solid image pattern.
Figure 15:
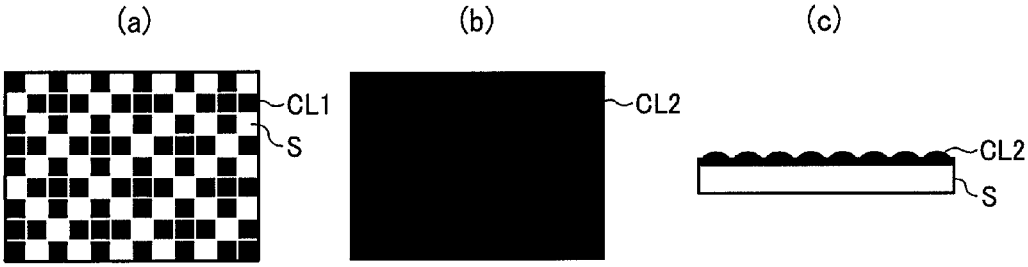
FIGS. 15(*a*)-(*c*) are drawings showing a relationship between a quantity of a clear and colorless toner and a high density square image pattern.
Figure 16:
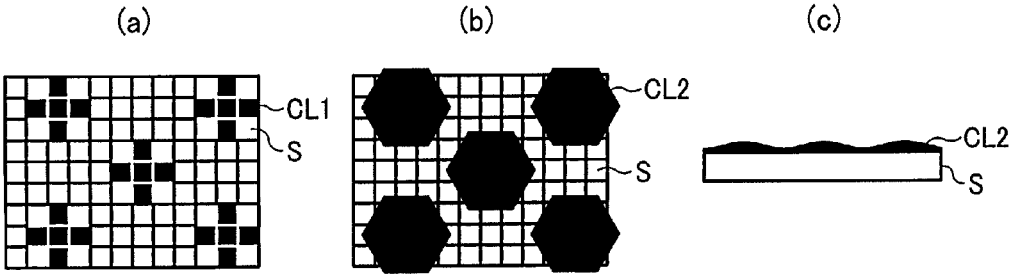
FIGS. 16(*a*)-(*c*) are drawings showing a relationship between a quantity of a clear and colorless toner and a low density square image pattern.

Referring to FIG. 14, FIG. 15 and FIG. 16, the relationship between image forming pattern and quantity of clear toner is explained. FIG. 14 shows an example of a solid pattern. FIG. 15 and FIG. 16 show examples of half tone dot images. In FIG. 14, FIG. 15 and FIG. 16, (a) shows a plan view of toner image on a paper before fixing, (b) shows it after fixing, and (c) shows the front view and side view of (b). Each of the squares in (a) is a pixel.

Because the image pattern shown in FIG. 14 (*a*) puts clear toner image CL1 on all pixels, the clear toner image layer CL2 is formed after fixing to cover the paper S wholly with substantially constant thickness like FIG. 14(*b*) and FIG. 14(*c*).

Because the exemplary image pattern shown in FIG. 15 (*a*) puts clear toner image CL1 on pixels to form cross patterns in front, back, right and left alternately, the clear toner image layer CL2 becomes a thinner layer than the one shown in FIG. 14 and covers the paper S wholly and hubbly after fixing.

Because the exemplary image pattern shown in FIG. 16 (*a*) puts clear toner image CL1 on pixels to form cross patterns in front, back, right and left with a predetermined distance alternately, the clear toner image layer CL2 becomes a thinner layer than the one shown in FIG. 15 and covers the paper S wholly after fixing. If the distance between the cross patterns is made shorter, the clear toner image layer CL2 becomes a thicker layer than the one shown in FIG. 15. Thus, changing an image forming pattern enables control of the quantity of clear toner at the top of the toner layers.

The controller 73 makes it possible for a user to switch a paper type detection from being active or not by a setting operation display panel as is the case with the exemplary controller 72 of the second embodiment. Switching is done by setting a paper type to a feeding paper tray. For example, if the user set the feeding paper tray 1 to normal papers for PPC and the feeding paper tray 2 to postcards, then paper type isn't detected. If the user doesn't set the feeding paper tray to paper type, then paper type is detected.

Figure 17:
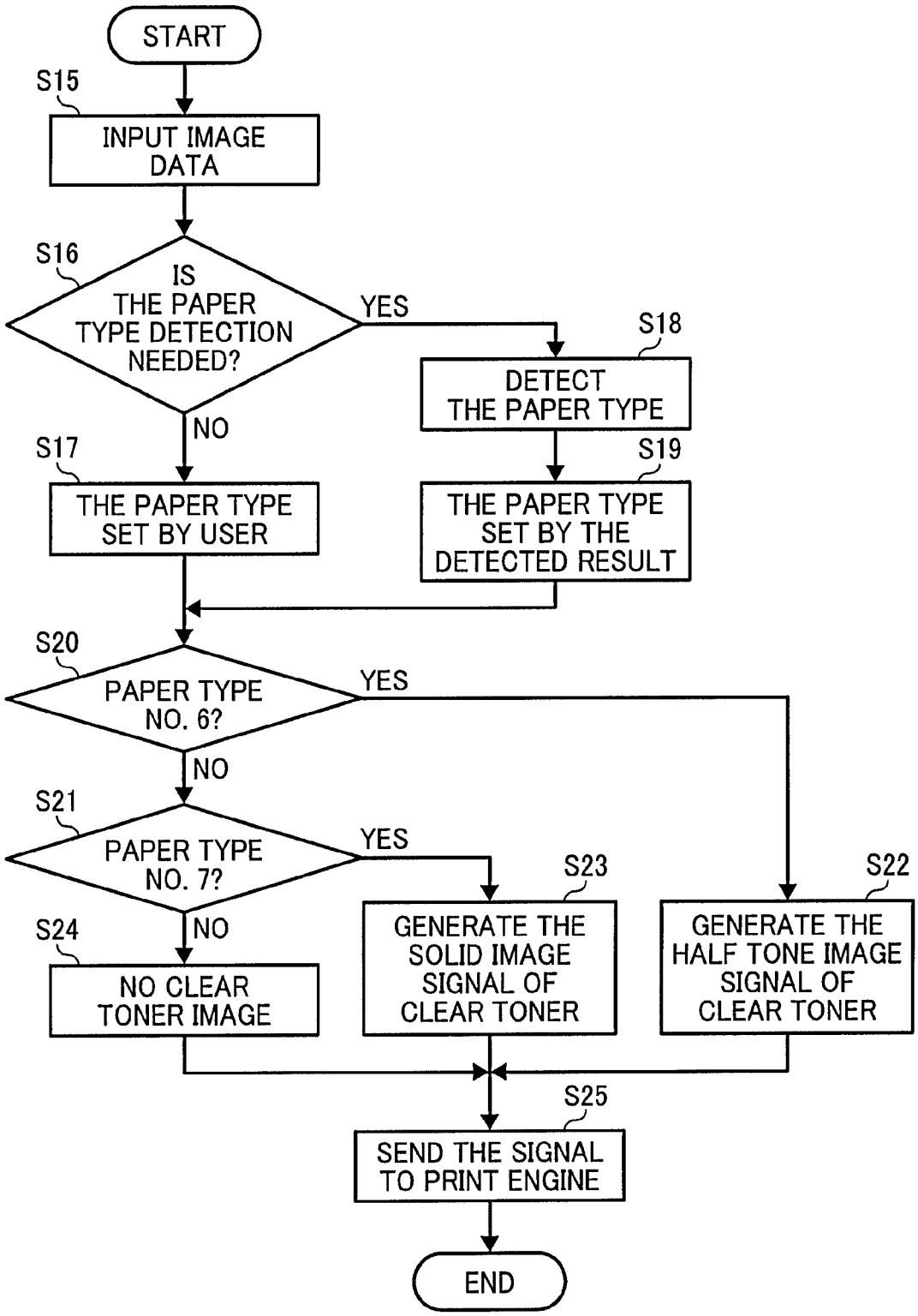
FIG. 17 is a flowchart showing an exemplary algorithm for determining a fixing condition in the third embodiment.

Next, an exemplary sequence by the controller 73 from image data input to decision of the fixing condition shown in FIG. 17 will be explained.

Firstly, image data is inputted from a scanner unit, personal computer or other processing device to the controller 73 (S15). The controller judges the need of paper detection (S16). If the paper detection is not needed, that is, then the user sets the feeding paper tray to the paper type (S16 No), and the controller 73 sets a paper type number according to the user setting (S17). If the paper detection is needed, that is, the user doesn't set the feeding paper tray to the paper type (S16 Yes), then the controller 73 executes the paper detection (S18).

The controller 73 compares the detected information from the paper detecting unit with the threshold values stored in the information storage unit 731 and decides paper type number (S19). After the decision of the paper type, the controller 73 judges whether the paper type is No. 6 shown in FIG. 13 or not (S20). If it is No. 6 (S20 Yes), then a clear toner image is formed at the top of the toner layers. That is, electrostatic image forming signals are generated to form the half tone dot image shown in FIG. 15 (S22) and sent to the print engine (S25).

If the paper type is not No. 6 (S20 No), then the controller 73 judges whether the paper type is No. 7 or not (S21). If it is No. 7 (S21 Yes), then a clear toner image is formed at the top of the toner layers. That is, electrostatic image forming signals are generated to form the solid image shown in FIG. 14 (S23) and sent to the print engine (S25). If it is not No. 7 (S21 No), then a clear toner image is not formed at the top of the toner layers. The controller 73 sends signals not to form the clear toner image (S25).

The image forming apparatus in this third embodiment provides a good fixing state in each paper type because it controls clear toner quantity that is lower fixing temperature toner quantity based on paper type.

Fourth Embodiment

In this embodiment, the lower toner fixing temperature toner is set to clear toner to give surface glossiness to the image and no affection to color images. The image forming apparatus in the fourth embodiment uses the area coverage modulation method like the third embodiment and changes half tone image density and clear toner quantity to prevent the poor fixing state and controls surface glossiness of toner image.

Firstly, the relationship between the half tone dot image changed by the area coverage modulation method and surface glossiness of the toner image will be explained. Making clear toner image CL2 on the surface of color toner image CP including yellow, magenta, cyan, or black toner (FIG. 18) and changing the half tone dot area ratio (toner dot area per 1 pixel area on a paper) of the clear toner image CL2, the surface glossiness of the toner image was measured by the measurement method JIS Z 8741 (60 degree glossiness). The measurement was done in different half tone dot area ratios of color toner image. The results are shown in FIG. 19.

The half tone dot area ratio of the clear toner was set to 100% (a solid image), 70%, 50%, 20%, 10%, 5%, and 0% (no clear toner). The paper was a plain paper for PPC. And the half tone dot area ratio of color toner image means total half tone dot area ratio of color toner image including yellow, magenta, cyan, and black toner.

Figure 19:
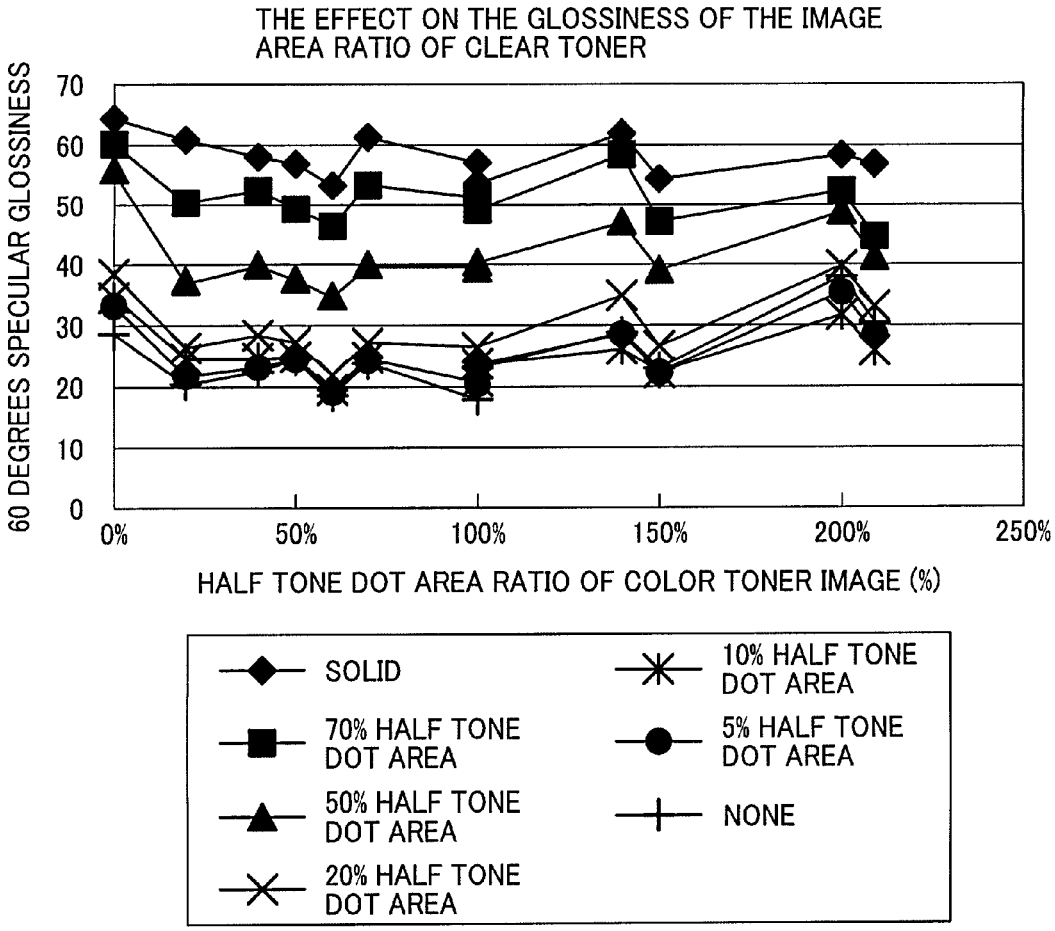
FIG. 19 is a line graph showing an exemplary relationship between a glossiness of toner image surface and half tone dot area ratio of a clear and colorless toner image, where the clear and colorless toner is a lower fixing temperature toner.

As shown in FIG. 19, glossiness became higher in the order corresponding to the half tone dot area ratio of the clear toner: 100% (solid image), 70%, 50%, 20%, 10%, 5%, and 0% (no clear toner), in every half tone dot area ratios of color toner image. This means the surface glossiness can be changed by the half tone dot area ratio of the clear toner image CL2 at the top of the toner layers in any half tone dot area ratios of color toner image.

Hence the surface glossiness of the toner image can be controlled by changing the half tone dot area ratio of the clear toner image CL2. In order to control the surface glossiness of the toner image easily and correctly, it is preferable to set a linear relationship between the half tone dot area ratio of the clear toner image CL2 and its glossiness. Lines per inch of clear toner image CL2 were investigated for the lines per inch in which the relation between its half tone dot area ratio and glossiness becomes linear. The results are explained in FIG. 20 and FIG. 21.

Figure 18:
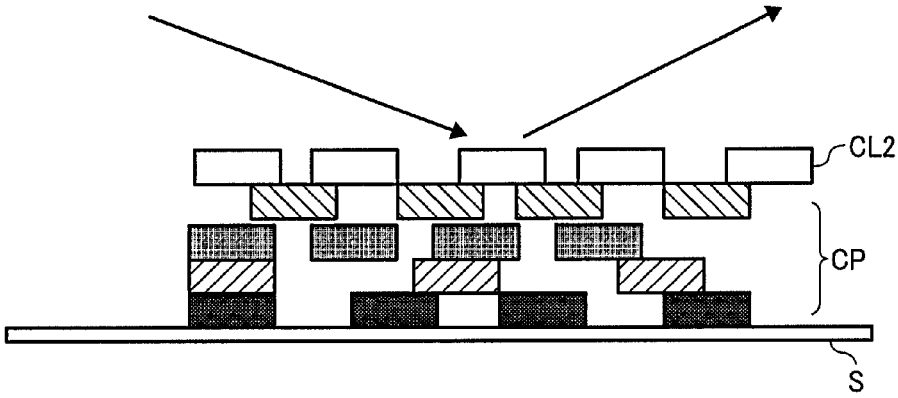
FIG. 18 is a drawing showing a structural arrangement of toner layers.

Glossiness changing rate was measured when the clear toner image CL2 is formed in different lines per inch on the surface of the color toner image CP made by yellow, magenta, cyan, and black toner as in FIG. 18. As is shown FIG. 20, the half tone dot area ratio of the clear toner image CL2 was also changed from 0% to 100% in its measurement.

The different lines per inch of the clear toner image CL2 were 300 lpi, 210 lpi, 170 lpi, 150 lpi, and 75 lpi. The paper was plain papers for PPC, and glossiness changing rate is expressed in percentage. 100% means the glossiness of solid image of the clear toner and 0% means the glossiness when there is no clear toner on the image. The intermediate value means the glossiness changing rate between the glossiness of solid and the one of no clear toner.

Figure 20:
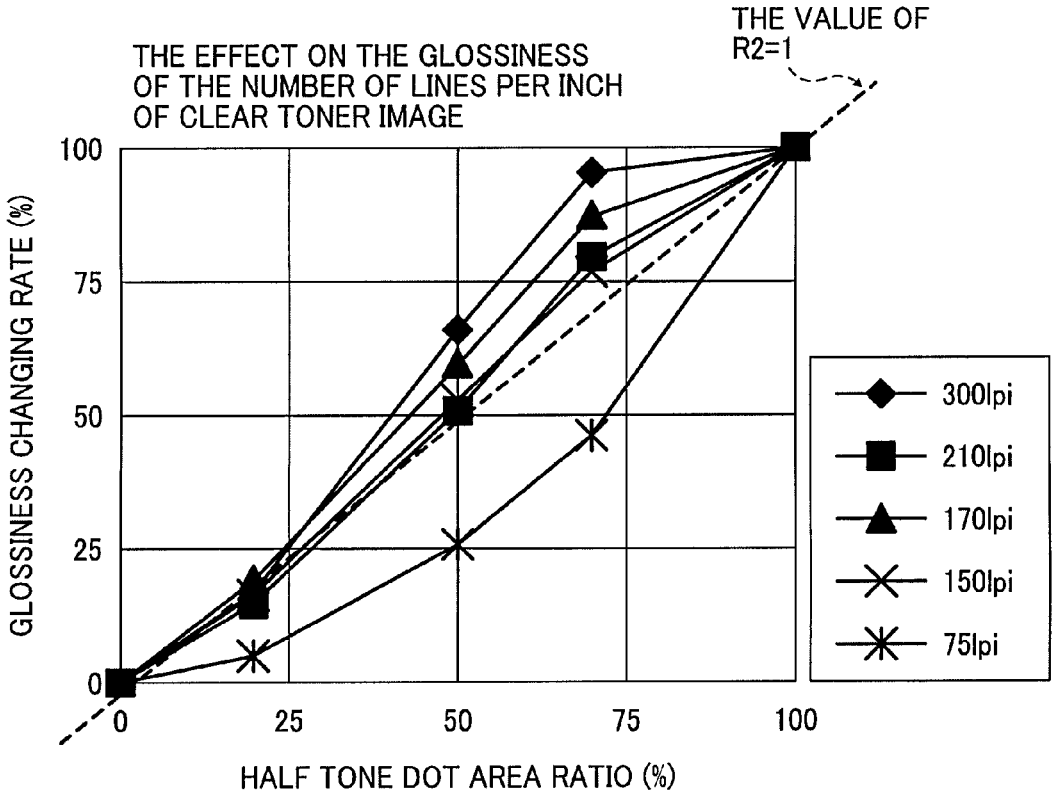
FIG. 20 is a line graph showing an exemplary relationship between a glossiness changing rate and half tone dot area ratio with different numbers of lines per inch of a clear and colorless toner image, where the clear and colorless toner is a lower fixing temperature toner.

As is shown in FIG. 20, the linearity between glossiness changing rate and the half tone dot area ratio of the clear toner image CL2 changed in the lines per inch of the clear toner image. The linearity of 210 lpi and 150 lpi is better than that of 75 lpi, 170 lpi and 300 lpi shown in FIG. 20 and FIG. 21.

Figure 21:
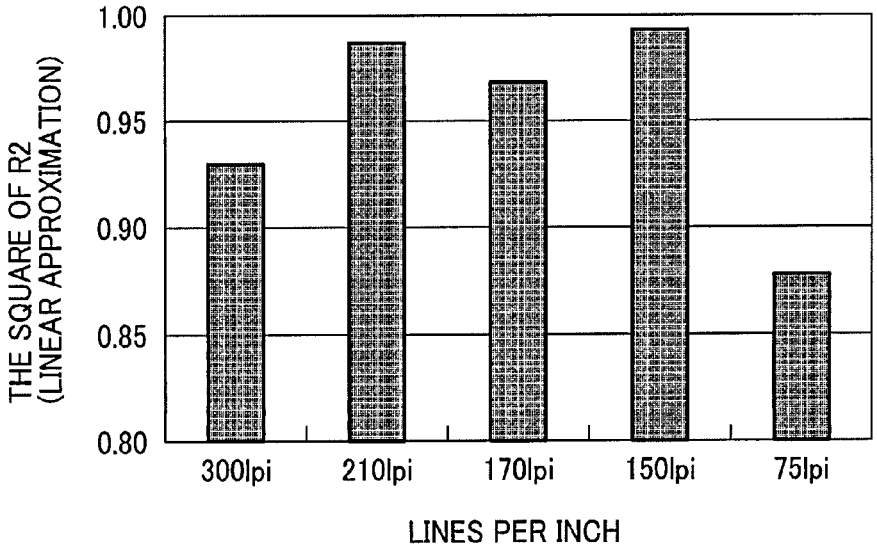
FIG. 21 is a bar graph showing exemplary R square data.

Therefore the preferable lines per inch of the clear toner image for the glossiness control and preventing poor fixing quality are 210 lpi and 150 lpi because these lines per inch enable easy and correct control. The square of R2 shown in FIG. 21 shows the linearity level. As the value gets near to 1, the linearity is improved.

Based on the above, the fourth embodiment is explained. The image forming apparatus in the fourth embodiment has a controller 74 and the paper type detecting unit 8 discussed in the second embodiment. The controller 74 shown in FIG. 22 has an information storage unit 741, an image data processing unit 742, an operation display panel 743, and the structure shown in the first embodiment.

The information storage unit 741 stores threshold values to identify the paper type based on the detected information from the paper detecting unit 8, existence information of clear toner image that is related to whether clear toner should exist with each paper type (that shows which paper type needs clear toner covering), and the information of halftone dot area ratio of the clear toner image to paper type that needs lower fixing temperature toner.

The image data processing unit 742 makes digital electrostatic latent image signals (e.g., signals for generating half tone dot images) for forming images of toner like yellow, magenta, cyan, and black toner from image data (raster image data) based on the total quantity toner control and judges whether digital electrostatic latent image signals for clear toner images should be made or not based on a paper type. When digital electrostatic latent image signals for clear toner images are generated, the image data processing unit 742 judges whether the surface glossiness processing is chosen or not, chooses, and decides the half tone dot area ratio of the clear toner image. When the surface glossiness processing is executed, the image data processing unit 742 chooses and decides the half tone dot area ratio of the clear toner image based on the need of lower fixing temperature toner.

The choice and decision of half tone dot area ratio, based on the need of lower fixing temperature toner in the surface glossiness processing is explained as follows. For example, in the third embodiment shown in FIG. 13, the paper type number 6 is set with a half tone dot image. In this embodiment shown in FIG. 23, the setting value of half tone dot image for the paper type number 6 has a minimum half tone dot area ratio to prevent a poor fixing state (the exemplary value is 50% in FIG. 23). Additionally, if a user wants surface glossiness processing, the half tone dot area ratio for the wanted glossiness is set. Lines per inch for a half tone dot image are preferably 210 lpi or 150 lpi stated above that enables glossiness control easily and correctly.

In the third embodiment shown in FIG. 13, the image pattern of the clear toner is not set for paper type from No. 1 to No. 5 because these paper types do not require adding clear tone image to prevent a poor fixing state. However, in this fourth embodiment shown in FIG. 23, image patterns of clear toner are set for paper types from No. 1 to No. 5 as a half tone dot image (the half tone dot area ratio is set from 0% to 100%) to change the surface glossiness of the toner image. In the image forming apparatus of the fourth embodiment, a user can choose a half tone dot area ratio according to five levels from 0% to 100%. About paper type No. 6, a minimum half tone dot area ratio is set to prevent the poor fixing state without a user setting the surface glossiness (e.g. 50%).

Operation display panel 743 works as a user interface to display information and set information such as the surface glossiness and feeding paper tray related to a paper type.

The exemplary display for the surface glossiness setting in the operation display panel 743 is shown in FIG. 24. In FIG. 24, the number from 1 to 5 means the glossiness level. A higher number means higher glossiness. Touching the square under the number from 1 to 5, the touched square is lighted up and user can look at the choice. In FIG. 24, user chooses surface glossiness "2," and the respective square is filled.

The exemplary operation display panel 743 is set in the image forming apparatus. However, when the image forming apparatus is connected to outer machines (e.g. personal computers) via a network I/F, the operation display can be shown in the outer machines.

Next, the action in the controller 74 is explained. The controller 74 receives a user's request about executing the glossiness processing or not and its level via the operation display panel. It receives the information detected by the paper detecting unit 8, identifies the paper type, judges whether the identified paper should be covered with the lower fixing temperature toner, and decides executing the surface glossiness processing or not.

When the paper type needs the lower fixing temperature toner and the user doesn't request the surface glossiness processing, a minimum half tone dot area ratio is set to prevent the poor fixing state and the clear toner image is made. When the paper type requires the lower fixing temperature toner and the user requests the surface glossiness processing, the half tone dot area ratio is set according to the user request and the clear toner image is made. When the paper type doesn't require the lower fixing temperature toner and the user doesn't request the surface glossiness processing, the clear toner image is not made. When the paper type doesn't require the lower fixing temperature toner and the user requests the surface glossiness processing, the half tone dot area ratio is set according to the user request and the clear toner image is made.

The image forming apparatus in this fourth embodiment not only prevents the poor fixing state but also controls the surface glossiness of toner image because the gradation of clear toner image is changed (that is, the quantity of clear toner is changed) by using the area coverage modulation method.

The Fifth Embodiment

The image forming apparatus in the third embodiment makes a half tone dot image in a predetermined half tone dot area ratio. In the image forming apparatus in the fifth embodiment, the controller 73 in the third embodiment is changed to make a half tone dot image based on an energy saving mode. The structure of the image forming apparatus is explained by using FIG. 22 in the fourth embodiment. The parts that note other numbers in brackets are different parts in the fifth embodiment from the fourth embodiment. The same parts are shown in same numbers and the detailed explanation thereof is omitted.

Figures 22, 23:
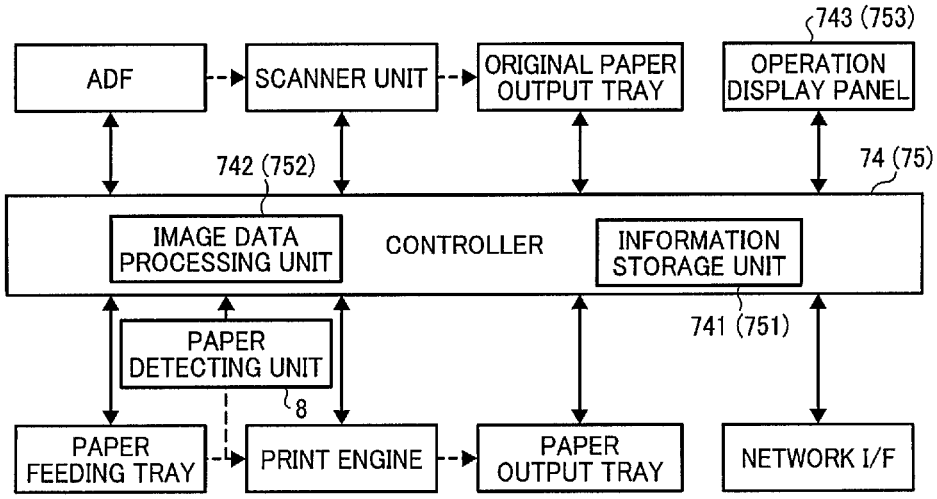
FIG. 22 is an explanatory block diagram showing the relationship among a controller and other units in a fourth embodiment.
FIG. 23 is a table showing a examples of characteristics of each paper type in the fourth embodiment.

The controller 75 in the fifth embodiment shown in FIG. 22 comprises an information storage unit 751, an image data processing unit 752, and an operation display panel 753.

The information storage unit 751 stores threshold values to identify the paper type based on the detected information from the paper detecting unit 8, existence information of a clear toner image at the top of the toner layers that is related to whether the clear toner should exist for each paper type, the information of the clear toner image forming pattern that is related to paper type to control the quantity of the lower fixing temperature toner at the top of the toner layers, and energy saving mode information.

The energy saving mode is explained as follows. As already stated, after the solid image shown in FIG. 14(*a*), the half tone dot image shown in FIG. 15(*a*) and another half tone dot image shown in FIG. 16(*a*) which has lower half tone dot area ratio are fixed by fixing unit, the thickness of the clear toner image is thinner in the order of the figure numbers. A thicker clear toner image is provided with a better fixing state, and has a lower fixing temperature, but there is much consumption of clear toner. On the other hand, less clear toner consumption needs the higher fixing temperature, which would mean more electricity consumption.

The energy saving mode information is the data set that includes different lower fixing temperature toner image data to decrease the fixing temperature step by step. An example is shown in FIG. 25.

The table shown in FIG. 25 includes the results obtained by changing the fixing temperature, half tone dot area ratio and lines per inch of the clear toner image to keep the fixing state rank 4. The experimental condition was as follows.

Machine: a color MFP Imagio Neo C7500 made by Ricoh
Paper: POD gross coat 128 g/cm2 paper made by Ohji Seishi
Clear toner: toner A used in first embodiment The image under the clear toner image (herein called lower image) was made on the paper by toner B used in the first embodiment. The image was monochrome gray scale that has an image area ratio of 50%. The image forming conditions are as follows.

Image processing (RIP) software: Photoshop made by Adobe
Resolution: 600 dpi
Half tone dot degree: 45 degrees
Dot form: line It was evaluated how the clear toner covers the lower image in different lines per inch and half tone dot area ratios. The results showed that clear toner image has the higher half tone dot area ratio and lower lines per inch cover thicker on the lower image. This makes it possible to decrease the fixing temperature. On the other hand, clear toner image has the lower half tone dot area ratio and higher lines per inch covers thinner on the lower image. This means the effect lowering the fixing temperature becomes less effective but makes possible to decrease clear toner consumption.

The table shown in FIG. 25 relates priority number to the control information like the fixing temperature, half tone dot area ratio and lines per inch of the clear toner image. The control information is stored in the information storage unit 751. The table shown in FIG. 25 is exemplary. In FIG. 25, a smaller priority number means giving priority to a lower fixing temperature. On the other hand, a bigger priority number means giving priority to a decrease in clear toner consumption.

The image data processing unit 752 makes digital electrostatic latent image signals (e.g. signals for generating half tone dot images) for forming images of toner like yellow, magenta, cyan, and black toner from image data (raster image data) based on the total quantity toner control and judges whether digital electrostatic latent image signals for clear toner images should be made or not based on a paper type. The image data processing unit 752 chooses, decides and generates the image forming pattern of the clear toner image.

In this fifth embodiment, the image forming pattern is a solid pattern or half tone dot patterns. The solid pattern covers a paper wholly. The half tone dot patterns are five patterns that change a half tone dot area ratio step by step. A user can choose a half tone dot image according to the energy saving request.

Operation display panel 753 works as a user interface to display information and set information such as the energy mode setting and feeding paper tray related to a paper type.

The exemplary display for the energy saving mode setting in the operation display panel 753 is shown in FIG. 26. In FIG. 26, the number from 1 to 5 in energy mode setting (hereinafter called energy saving mode number) corresponds to the priority numbers (1~5) shown in FIG. 25. The blank box under the energy saving mode number is lighted up and user can view the choice. In FIG. 26, the user chooses the energy saving mode "2" (priority number 2 in FIG. 25).

The exemplary operation display panel 753 is set in the image forming apparatus. However, when the image forming apparatus is connected to outer machines (e.g. personal computers) via network I/F, the operation display can be shown in the outer machines.

Figure 27:
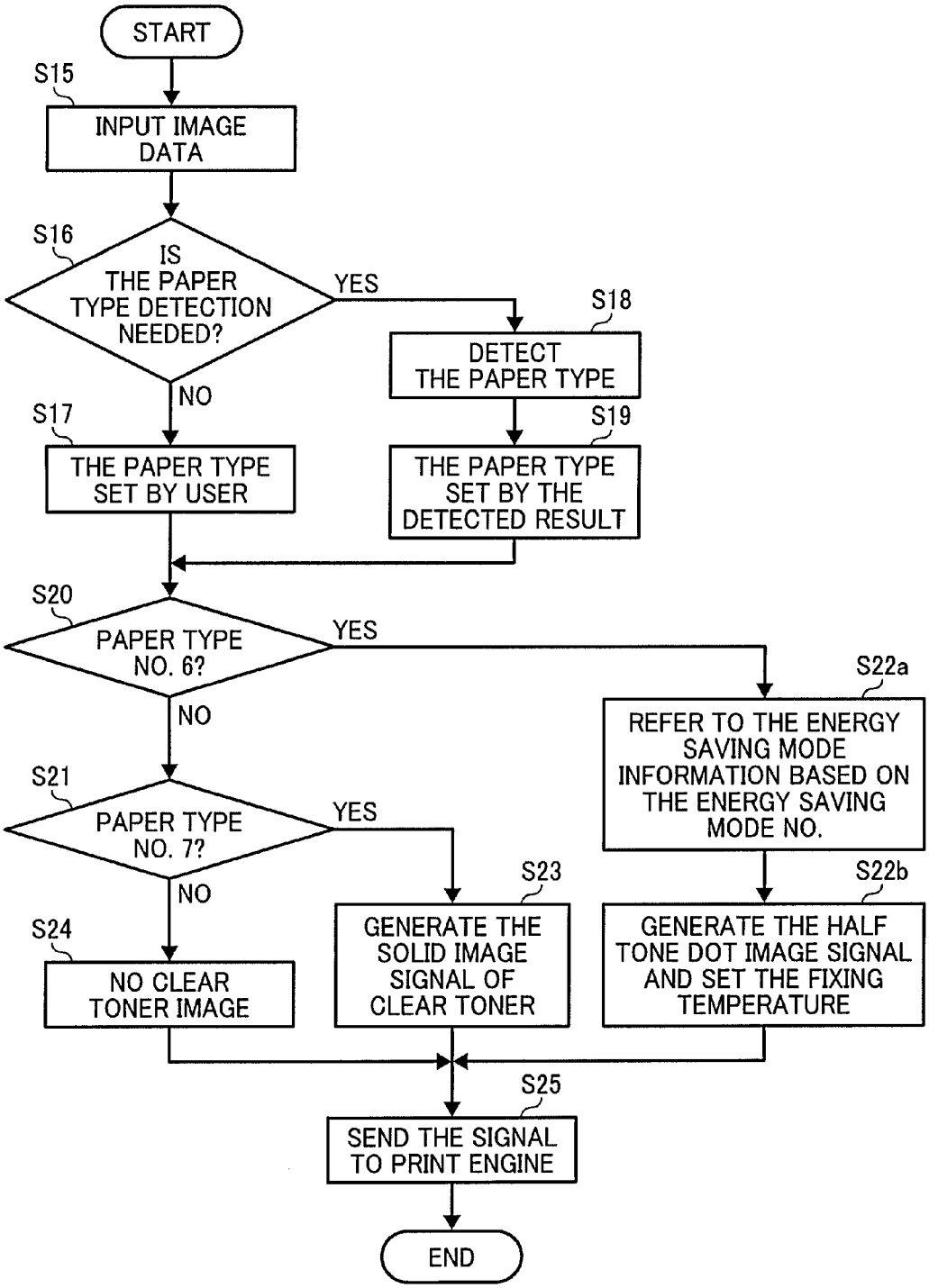
FIG. 27 is a flowchart showing an exemplary algorithm for determining a fixing condition in a sixth embodiment.

Next, an exemplary sequence by the controller 75 from image data input to decision of the fixing condition shown in FIG. 27 will be explained. The flowchart in FIG. 27 has the same steps as in FIG. 17 other than S15 and S22.

The controller 75 inputs the image data from the scanner unit, personal computer or other processing device, and the energy saving mode number instructed by a user from operation display panel 753 (S15*a*). The controller judges the need of paper detection (S16). If the paper detection is not needed, that is, the user sets the feeding paper tray to the paper type (S16 No), then the controller 75 sets a paper type number according to the user setting (S17). If the paper detection is needed, that is, the user doesn't set the feeding paper tray to the paper type (S16 Yes), then the controller 73 executes the paper detection (S18).

The controller 75 compares the detected information from the paper detecting unit 8 with the threshold values stored in the information storage unit 731 and decides a paper type number (S19). After the decision of the paper type, the controller 73 judges whether the paper type is No. 6 shown in FIG. 13 or not (S20).

If it is No. 6 (S20 Yes), then the controller 75 refers to the energy saving mode information based on the energy saving mode number inputted by a user. For example, if a user input energy saving mode No. 2, then the controller 75 refers the energy saving mode information of priority number 2 in FIG. 25 (half tone dot area ratio: 84%, screen line number: 80 lpi, dot geometry: line, screen angle: 45 degree, fixing temperature: 161° C.).

Controller 75 generates electrostatic image forming signals to form the half tone dot image based on the referenced energy saving mode information (S22*b*). The electrostatic image forming signals are sent to the print engine (S25). The controller 75 sets the constant control temperature for the fixing unit to the fixing temperature in the referred energy saving mode (S22*b*) and controls the print engine (S25).

In S20, if the paper type is not No. 6 (S20 No), then the controller 75 judges whether the paper type is No. 7 or not (S21). If it is No. 7 (S21 Yes), then a clear toner image is formed at the top of the toner layers. That is, electrostatic image forming signals are generated to form the solid image shown in FIG. 14 (S23) and sent to the print engine (S25).

In S21, if it is not No. 7 (S21 No), then a clear toner image is not formed at the top of the toner layers. The controller 73 sends signals not to form the clear toner image (S25).

In addition to the merits in the third embodiment, the image forming apparatus in the fifth embodiment provides an improvement of practical utility and functionality because half tone dot image processing is executed in accordance with a user's energy saving request when the paper is detected as the paper needed half tone dot image of clear toner.

The Sixth Embodiment

The image forming apparatus in the sixth embodiment controls a quantity of clear toner at the top of the toner layer by using a density gradation method in which the potential of an electrostatic latent image (the potential of exposed parts) is adjusted in multistep to control toner adhered quantity. The structure of the image forming apparatus is explained by using FIG. 12 in the third embodiment. The parts that note other numbers in brackets are different parts in the sixth embodiment from the third embodiment. The same parts are shown in same numbers and omitted the detail explanation.

The image forming apparatus in the sixth embodiment has a controller 76 and the paper type detecting unit 8 discussed in the second embodiment. The controller 76 shown in FIG. 12 has an information storage unit 761, an image data processing unit 762 and the structure shown in the first embodiment.

The information storage unit 761 stores threshold values to identify the paper type based on the detected information from the paper detecting unit 8, existence information of clear toner image that is related whether clear toner should exist on each paper type (that shows which paper type needs clear toner covering), the exposure power information that relates paper types to the exposure power to make the electrostatic latent image for clear toner images (that is, control quantity of clear toner).

The density gradation method is explained as follows. The potential of the electrostatic latent image formed on a photoconductor (the photoconductor drum in this embodiment) varies in direct proportion to exposure power that is light power of the light from the exposure unit. Toner adhered quantity on the photoconductor varies in direct proportion to the potential. Therefore, exposure control becomes means to control the toner quantity on the paper. As an exposure control power method, there are power modulation methods in which exposure power is changed in constant exposure time and pulse modulation method in which exposure time is changed in constant exposure power. Both methods are applicable in this embodiment.

FIG. 28 shows an example table that relates paper types (based on different basis weight) to each information. The examples shown in FIG. 28 include exposure power 50% for only paper type No. 6, exposure power 100% for only paper type No. 7 and paper type classified by basis weight, which are merely examples.

As shown in FIG. 28, the paper type number is related to the basis weight to identify paper, the existence of the clear toner image (that is the existence of the image of the lower fixing temperature toner) and their exposure powers to form the electrostatic latent images for clear toner images. Controllable information based on this table is stored in the information storage unit 761. Image patterns for No. 6 and No. 7 are solid patterns that have different exposure powers.

The image data processing unit 762 in FIG. 12 makes digital electrostatic latent image signals (e.g. signals for generating half tone dot images) for forming images of toner like yellow, magenta, cyan, and black toner from image data based on the total quantity toner control and judges whether digital electrostatic latent image signals for clear toner images should be made or not based on a paper type. The image data processing unit 762 chooses and decides the exposure power of the clear toner image.

Figure 29:
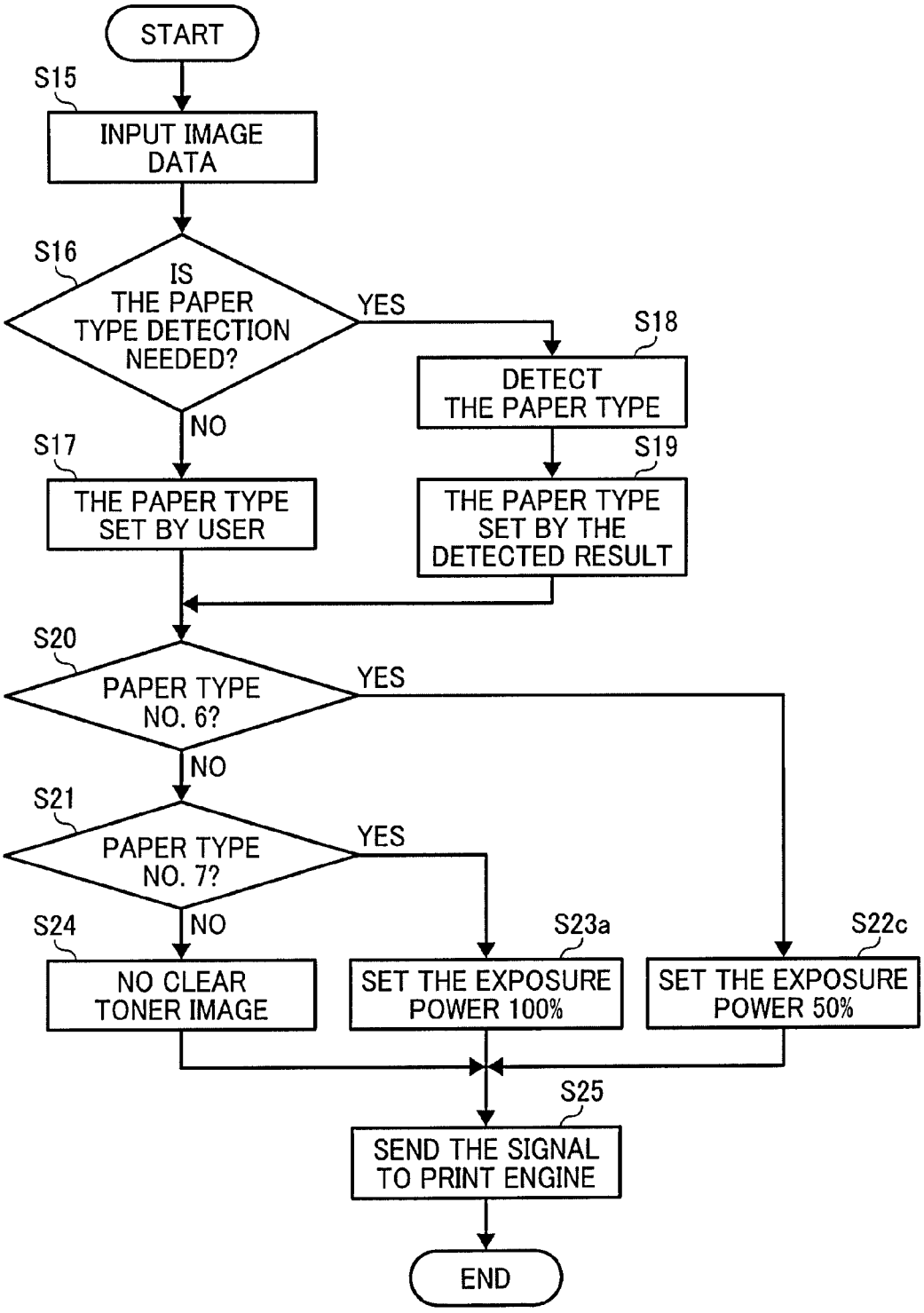
FIG. 29 is a flowchart showing an exemplary algorithm for determining a fixing condition in a seventh embodiment.

An exemplary sequence by the controller 76 from image data input to decision of the fixing condition shown in FIG. 29 is explained. The flowchart in FIG. 29 has the same steps in FIG. 17 other than S22 and S23. The explanation about the same steps is omitted.

The controller 76 compares the detected information from the paper detecting unit 8 with the threshold values stored in the information storage unit 731 and decides the paper type number. After the decision of the paper type, the controller 76 judges whether the paper type is No. 6 shown in FIG. 28 or not (S20). If it is No. 6 (S20 Yes), then the controller 75 sets the exposure power of the exposure unit 23*a* to 50% (S22*c*) and sends signals like the electrostatic latent image forming signal that forms the solid electrostatic latent image on the surface of the photoconductor drum 21*a* charged by charger 22*a* (S25).

In S20, if the paper type is not No. 6 (S20 No), then the controller 76 judges whether the paper type is No. 7 or not (S21). If it is No. 7 (S21 Yes), then the controller 75 sets the exposure power of the exposure unit 23*a* to 100% (S22*c*) and sends the signals like the electrostatic latent image forming signal that forms the solid electrostatic latent image on the surface of the photoconductor drum 21*a* charged by charger 22*a* (S25). In S21, if it is not No. 7 (S21 No), then a clear toner image is not formed at the top of the toner layers. The controller 75 sends signals not to form the clear toner image (S25).

The image forming apparatus in this sixth embodiment provides a constantly good fixing state in each different paper type because it controls a quantity of clear toner in each different paper type (the quantity includes 0). A control method for clear toner quantity may be mixed by both the density gradation method in the sixth embodiment and the area coverage modulation method in the third embodiment.

The Seventh Embodiment

When there is a document printed with color photographs and letters, it is effective to support a fixing state and give surface glossiness only on the photograph parts and not process the glossiness on the letter parts because photograph parts tend to stress the total quantity control limits, and letter part is generally fixed easily without processing. Therefore, the image forming apparatus in the seventh embodiment can make clear toner image CL2 at the top of the toner layers in any place of a paper. This apparatus has a structure with that of any of the other embodiments.

For example, the image forming apparatus in seventh embodiment has the following controller. The controller distinguishes letter parts and color photograph parts based on the image data when it generates digital electrostatic latent image forming signals for making color toner images considering total toner quantity control. The controller generates digital electrostatic latent image forming signals for clear toner image CL2 on the same place of color photograph parts and sends the signals to the exposure unit 23*a* to make clear toner image CL2.

The above embodiment automatically sets clear toner image CL2 on the photograph parts that can exist any place on the paper. Other embodiment can be considered that a user can set the clear toner image place by setting the operation display panel or outer machines connected to the image forming apparatus via network I/F.

The image forming apparatus in this seventh embodiment prevents, effectively, the problems of fixing offset, poor fixing state or a jam caused by adhesion of a paper and a fixing member because it makes clear toner image at the top of toner layers in any place that is needed.

Many embodiments can be considered other than above embodiments. The above embodiments have five image forming units including four process color units and one clear toner unit and the clear toner is lower fixing temperature toner. For example, another embodiment can be considered that has only four process color units. In such an embodiment, the toner transferred on the top of the toner layers is set as the lower fixing temperature toner. Another embodiment can be considered that has another toner (e.g., a metal color toner) instead of a clear toner.

The above embodiments are the examples of the image forming apparatuses but an image forming method can be considered that includes transferring the lower fixing temperature toner at the top of the toner layers on a paper.

The above exemplary image forming apparatus has an intermediate transfer belt. However, another embodiment can be considered that transfers toners from each photoconductor to a paper directly. In such embodiment, a transfer belt carries the paper.

What is claimed is:

1. An image forming apparatus, comprising:

a plurality of image making units configured to form and layer toner images on a recording medium, wherein a first image making unit of the plurality of image making units is configured to form a top layer toner image of the toner images on the recording medium with a first toner, and the first image making unit includes the first toner, which has a temperature characteristic that causes the first toner to be fixed at a lower temperature than that of a toner or toners of other image making units of the plurality of image making units.

2. The image forming apparatus according to claim 1, wherein the temperature characteristic is a fixing temperature of a lower limit.

3. The image forming apparatus as claimed in claim 1, wherein the temperature characteristic is a half-flow start temperature.

4. The image forming apparatus according to claim 1 wherein a fixing temperature of a lower limit and a half-flow start temperature of the first toner is lower than that of the toner or toners of the other image making units of the plurality of image making units.

5. The image forming apparatus according to claim 1, further comprising:

a fixing unit configured to fix the layered toner images on the recording medium to the recording medium according to a predetermined fixing condition; and a controller that decides the predetermined fixing condition based on a type of the recording medium.

6. The image forming apparatus according to claim 1, wherein the first toner is a clear and colorless toner.

7. The image forming apparatus according to claim 6, further comprising:

a controller configured to control an amount of the first toner used for the top layer toner image based on a user selection.

8. The image forming apparatus according to claim 7, wherein the controller is configured to control the amount of the first toner used for the top layer toner image based on the user selection, which is a selection of a gloss level to be applied to the recording medium.

9. The image forming apparatus according to claim 7, wherein the controller is configured to control a fixing temperature based on a user selection of fixing temperature.

10. The image forming apparatus according to claim 7, wherein the controller is configured to control the amount of the first toner by a gray scale transformation method.

11. The image forming apparatus according to claim 7, wherein the controller is configured to restrict an application area of the top layer toner image to particular portions of the recording medium.

12. The image forming apparatus according to claim 11, wherein the controller restricts the application area of the top layer toner image to portions of the recording medium which are to be fixed with graphics and not text.

13. The image forming apparatus according to claim 7, wherein the controller is configured to control the amount of the first toner by a pulse surface area modulation method.

14. The image forming apparatus according to claim 1, wherein the first toner is a color toner.

15. The image forming apparatus according to claim 14, further comprising:

a controller configured to control an amount of the first toner used for the top layer toner image based on a user selection.

16. The image forming apparatus according to claim 15, wherein the controller is configured to:

control a fixing temperature based on a user selection of fixing temperature, and control the amount of the first toner by a gray scale transformation method.

17. An image forming method comprising:

forming and layering toner images on a recording medium, wherein a top layer toner image of the toner images is formed and layered on the recording medium with a first toner, and the first toner has a temperature characteristic that causes the first toner to be fixed at a lower temperature than that of another toner layer or layers of the toner images.

18. The image forming method according to claim 17, wherein the temperature characteristic is a fixing temperature of a lower limit or is a half-flow start temperature.

19. The image forming apparatus according to claim 17, wherein a fixing temperature of a lower limit and a half-flow start temperature of the first toner is lower than that of the another toner layer or layers of the toner images.

20. The image forming method according to claim 17, wherein the first toner is a clear and colorless toner, and the method further comprises:

analyzing image data to discriminate graphics from text, such that the forming of the top layer toner image is restricted to and includes the graphics and does not include the text.

* * * * *